US006321911B1

(12) United States Patent
Raimer et al.

(10) Patent No.: US 6,321,911 B1
(45) Date of Patent: Nov. 27, 2001

(54) FRAGILITY PACKAGE

(75) Inventors: George Edwin Raimer, Saranac; Nicholas J. Malone, Rockford, both of MI (US)

(73) Assignee: Display Pack, Inc., Grand Rapids, MI (US)

( * ) Notice: Subject to any disclaimer, the term of this patent is extended or adjusted under 35 U.S.C. 154(b) by 0 days.

(21) Appl. No.: 09/495,235

(22) Filed: Jan. 31, 2000

(51) Int. Cl.[7] ..... B65D 21/00

(52) U.S. Cl. ..... 206/509; 206/503; 206/521; 220/4.23

(58) Field of Search ..... 206/320, 503, 206/508, 509, 512, 521, 591, 592, 701, 723; 220/4.22, 4.23; 224/929

(56) References Cited

U.S. PATENT DOCUMENTS 3,407,961 * 10/1968 Box ..... 206/512
4,735,310 * 4/1988 Lemery et al. ..... 206/512
5,127,526 * 7/1992 Vigue ..... 206/587
5,775,508 * 7/1998 Bongard et al. ..... 206/508
5,871,097 * 2/1999 Shida et al. ..... 206/521

FOREIGN PATENT DOCUMENTS

1640039 * 4/1991 (SU) ..... 206/512

* cited by examiner

*Primary Examiner*—David T. Fidei
(74) *Attorney, Agent, or Firm*—Warner Norcross & Judd LLP

(57) ABSTRACT

A fragility package having a pair of shell halves. The shell halves cooperatively define an envelope for closely retaining the article to be packaged and a plurality of fragility supports that extend outwardly beyond the envelope to protect the article from impacts. The package is preferably manufactured from a transparent material, such as an impact-modified polymer, that permits the article to be visually inspected without opening the package. The top and bottom surfaces of the package are shaped so that adjacent packages nest together when stacked one atop the other.

27 Claims, 24 Drawing Sheets

FRAGILITY PACKAGE

BACKGROUND OF THE INVENTION

The present invention relates to packages and more particularly to a fragility package for containing fragile articles.

The term "fragility package" refers to packages specially designed to protect fragile articles, such as electronic components (e.g. stereos, video cassette recorders, digital video disc players, computer printers, etc.). Fragility packaging is commercially available in a wide variety of configurations. One of the more conventional configurations includes expanded foam supports that support the article within a cardboard shell. Typically, the package will include eight supports, one supporting each corner of the article. Alternatively, the package may include two support halves, each defining a void corresponding to the shape of the article. The support halves generally enclose the entire article. With either configuration, the packaging company is required to order, stock and maintain an inventory of multiple parts, including cardboard boxes and the corresponding number of supports. Although the cardboard boxes can typically be collapsed to conserve space in inventory, the supports are typically not collapsible, and therefore require a significant amount of warehouse space. Further, packaging articles using these conventional package configurations requires separate manipulation and assembly of the box and supports. Another known problem with conventional fragility packages is that beads from the expanded foam supports have a tendency to break off and get caught in the packaged article, potentially causing damage to the article. Also, dust from the cardboard box can contaminate the article as well.

Additionally, conventional fragility packaging does not permit the packaged article to be viewed by a customer. Accordingly, in order to perform a visual inspection, a customer is required to open the package and remove the article. This creates a variety of problems, including the possibility that the article will be damaged by the customer, that accessories contained within the package will be misplaced or stolen, or that subsequent potential customers will be hesitant to purchase an article in an open package.

SUMMARY OF THE INVENTION

The aforementioned problems are overcome by the present invention which provides a clam shell fragility package. The clam shell package includes an envelope that supports the article toward the center of the package as well as fragility supports that extend from the envelope to protect the article from damage in the event of an impact. The fragility supports are preferably located in the corners of the package.

In a preferred embodiment, the package is manufactured from a transparent polymeric material with a conventional impact modifying additive. This material resists cracking or breaking under impact and permits the article, along with any accessories, to be visually inspected without opening the package.

In a more preferred embodiment, the fragility package is configured to permit multiple packages to nest together when stacked one upon the other. Preferably, the package includes a protrusion and an oppositely positioned, corresponding void. When stacked, the protrusion of one package is interfitted with the void in the adjacent package. The protrusion and void are preferably configured so that the packages can be reversed with respect to one another when stacked.

The present invention provides a clam shell fragility package that permits the packaged article to be visually inspected without opening. The envelope closely follows the contour of the article in various locations to provide excellent product viewing. The fragility supports provide improved protection for the article by absorbing impacts from various directions. Because of these characteristics, the package can be used during shipping and during display at the point of sale. The nesting configuration permits packaged articles to be stably stacked one atop another without the need for conventional dunnage or other materials for intersecuring the packages. Further, because the packages can be reversed when stacked, articles without centered weight distribution can be more stably stacked. Also, when stacked, the fragility supports bear the majority of the weight of any above packages and pass the weight directly to the floor or to any below packages. Accordingly, the article is not required to bear most of the weight of any above stacked packages. Even further, because of its clam shell construction, the package also improves inventory efficiency by eliminating the need to order, stock and maintain multiple packaging components. Additionally, open packages are easily nested within each other to dramatically reduce the space required to store the packages. Also, the package decreases labor cost of packaging articles by reducing the number of steps involved in packaging an article. In addition, the transparent package permits the customer to view the accessories packaged with the article. Further, stacked packages nest within each other. As a result, the overall height of stacked packages is reduced by the amount of nesting between the packages. This can yield significant savings in vertical space required to store and display packaged articles.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
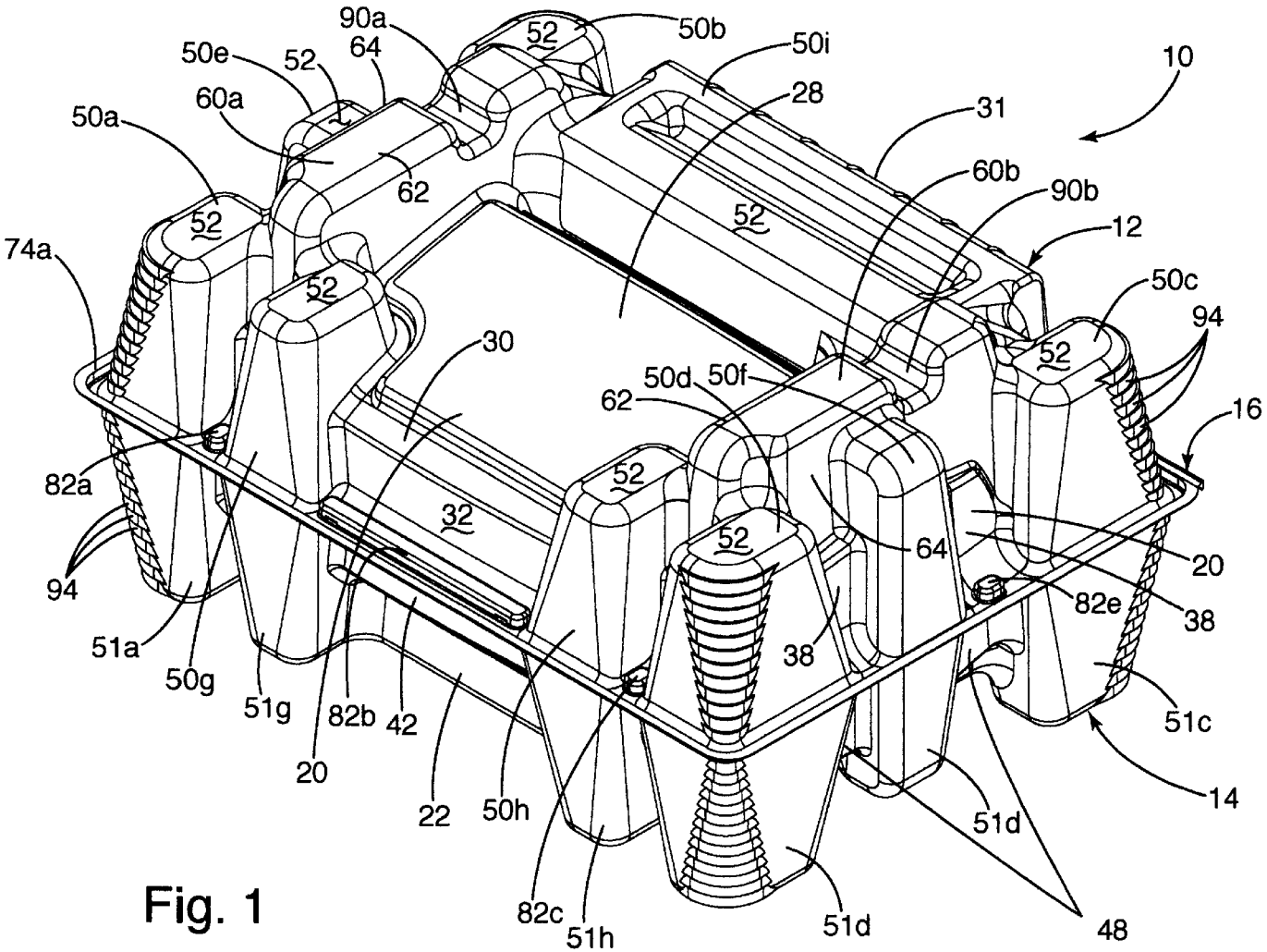
FIG. 1 is a perspective view of a fragility package in accordance with a preferred embodiment of the present invention showing the top thereof.
Figure 2:
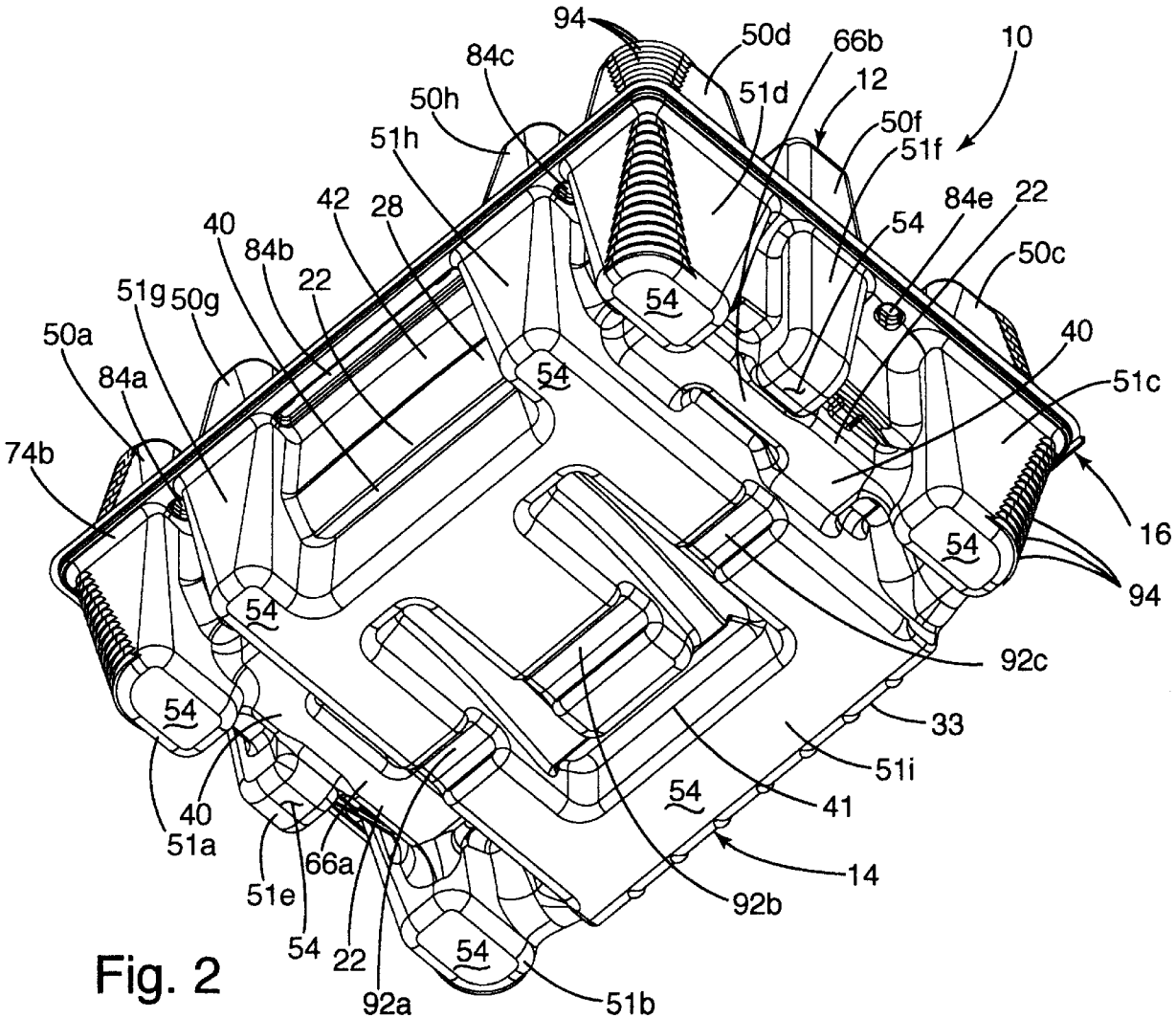
FIG. 2 is a perspective view of the fragility package showing the bottom of thereof.
Figure 3:
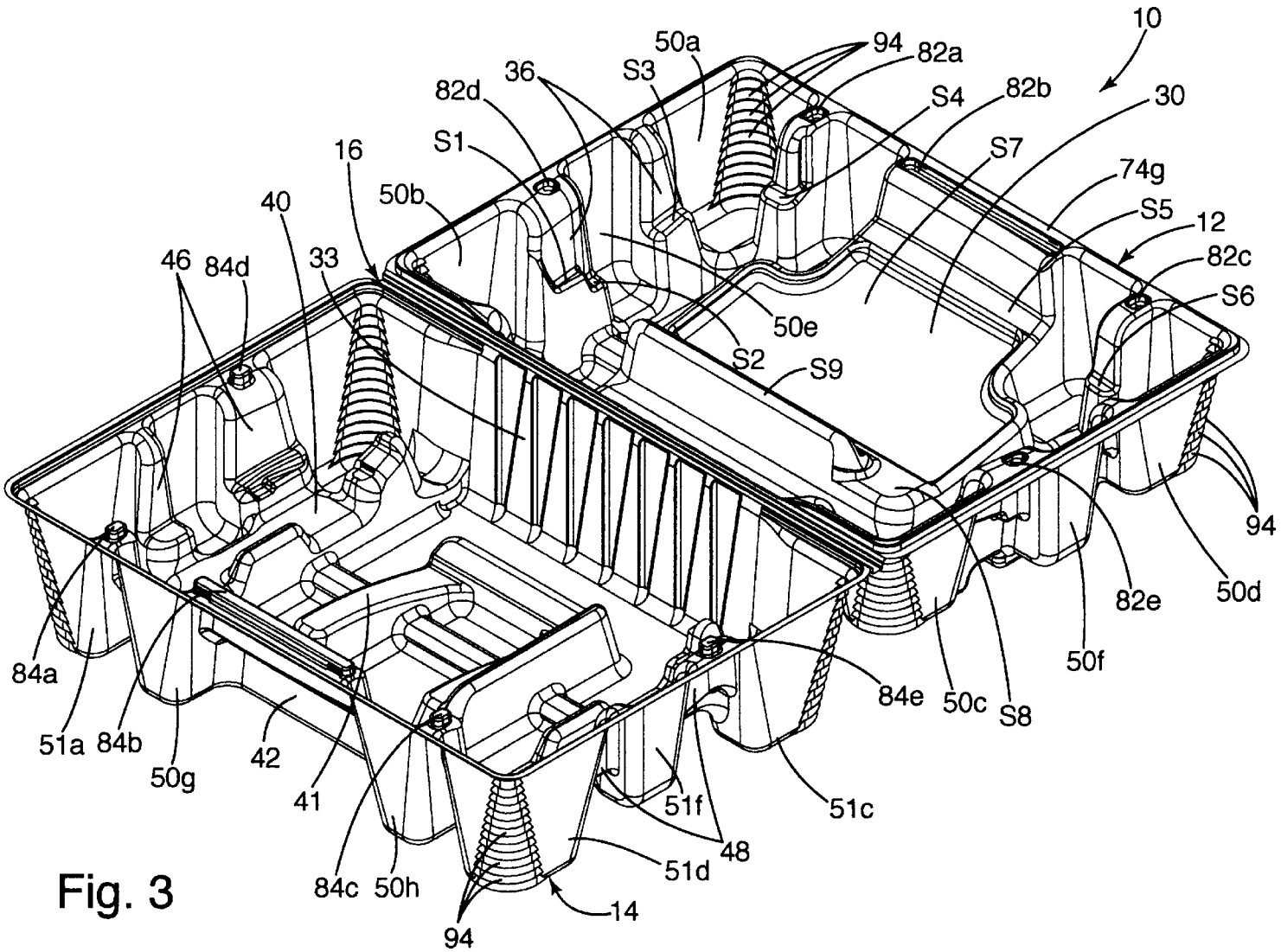
FIG. 3 is a perspective view showing the fragility package in the open position.
Figure 4:
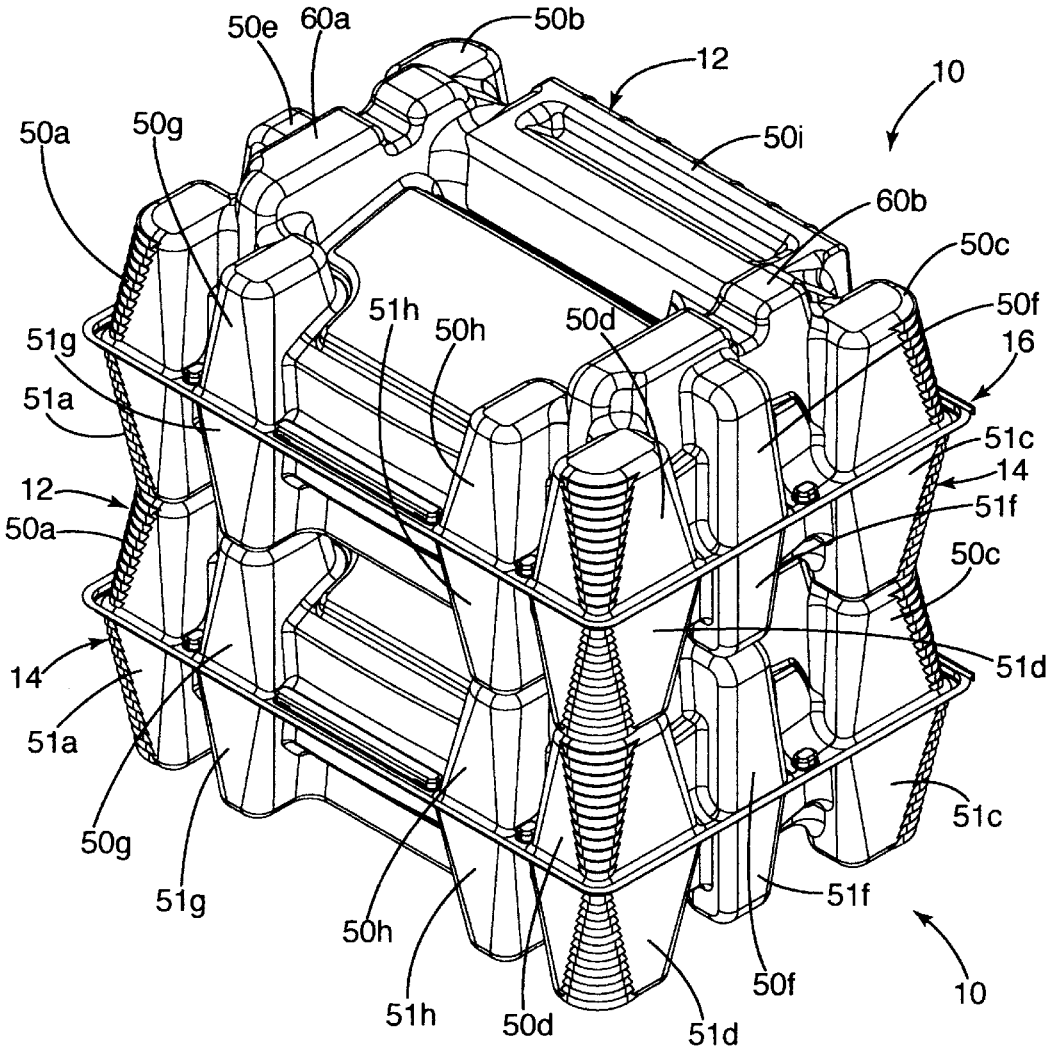
FIG. 4 is a perspective view showing two stacked fragility packages.
Figure 5:
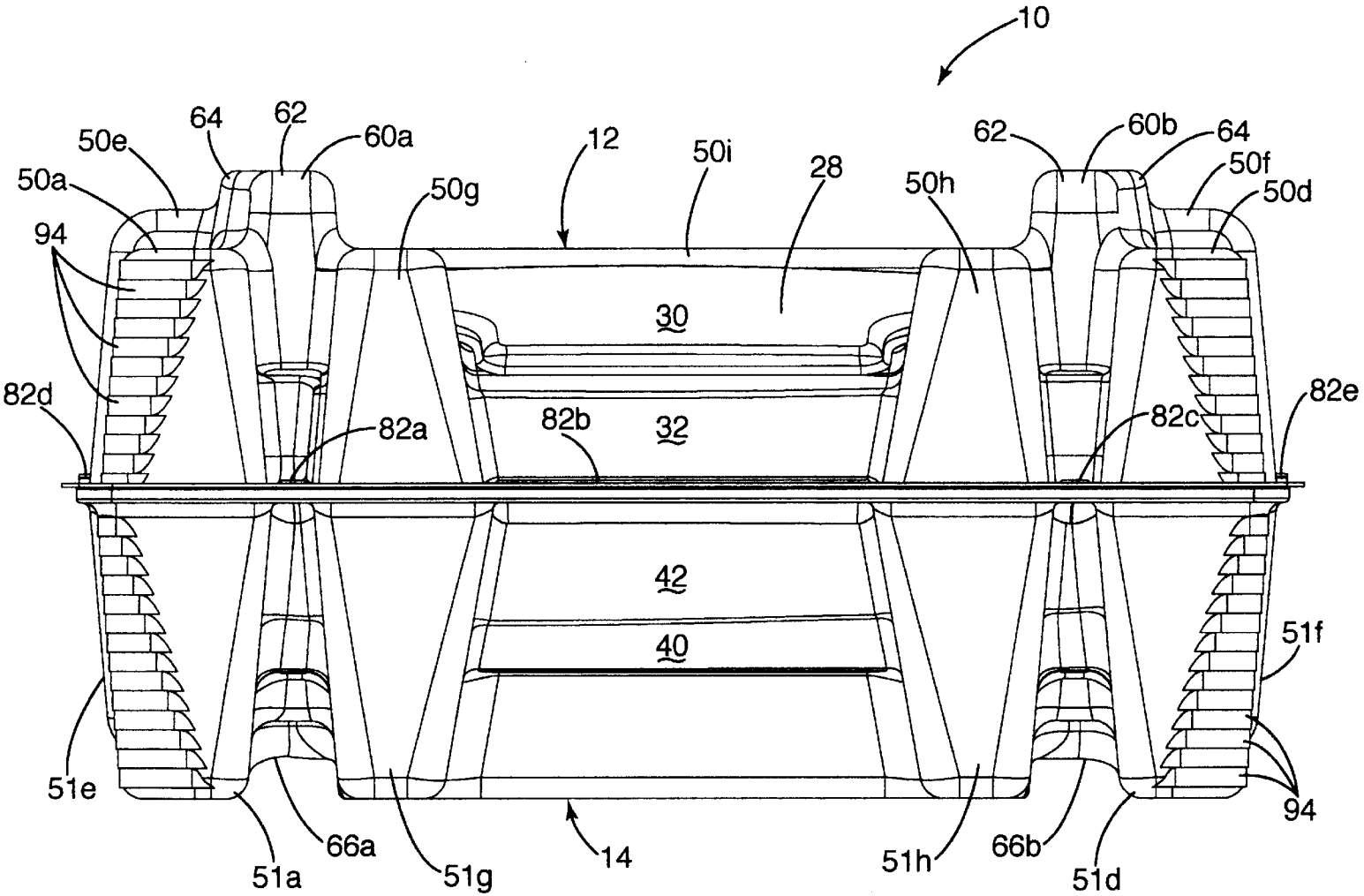
FIG. 5 is a front elevational view of the fragility package.
Figure 6:
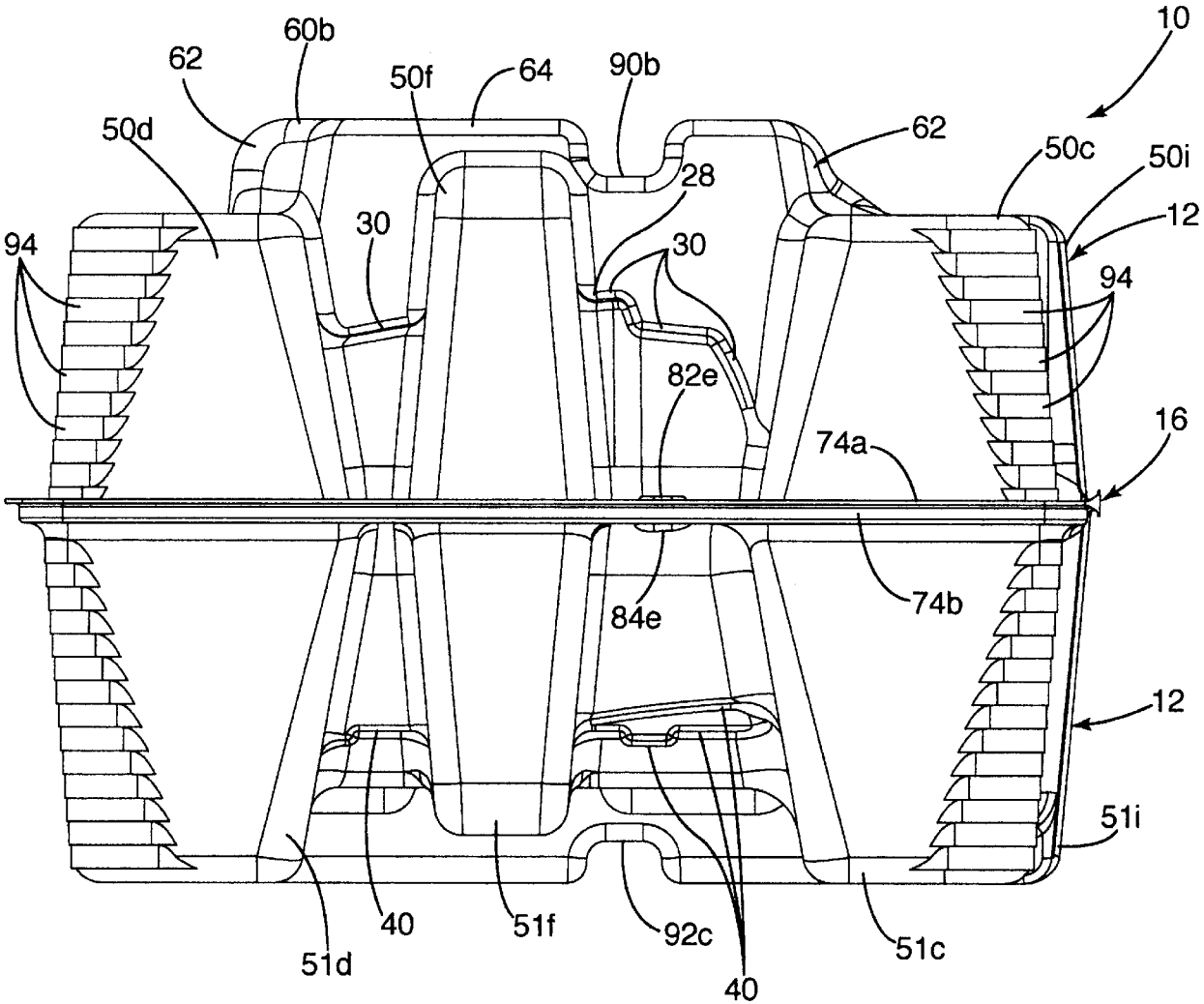
FIG. 6 is a right side elevational view of the fragility package.
Figure 7:
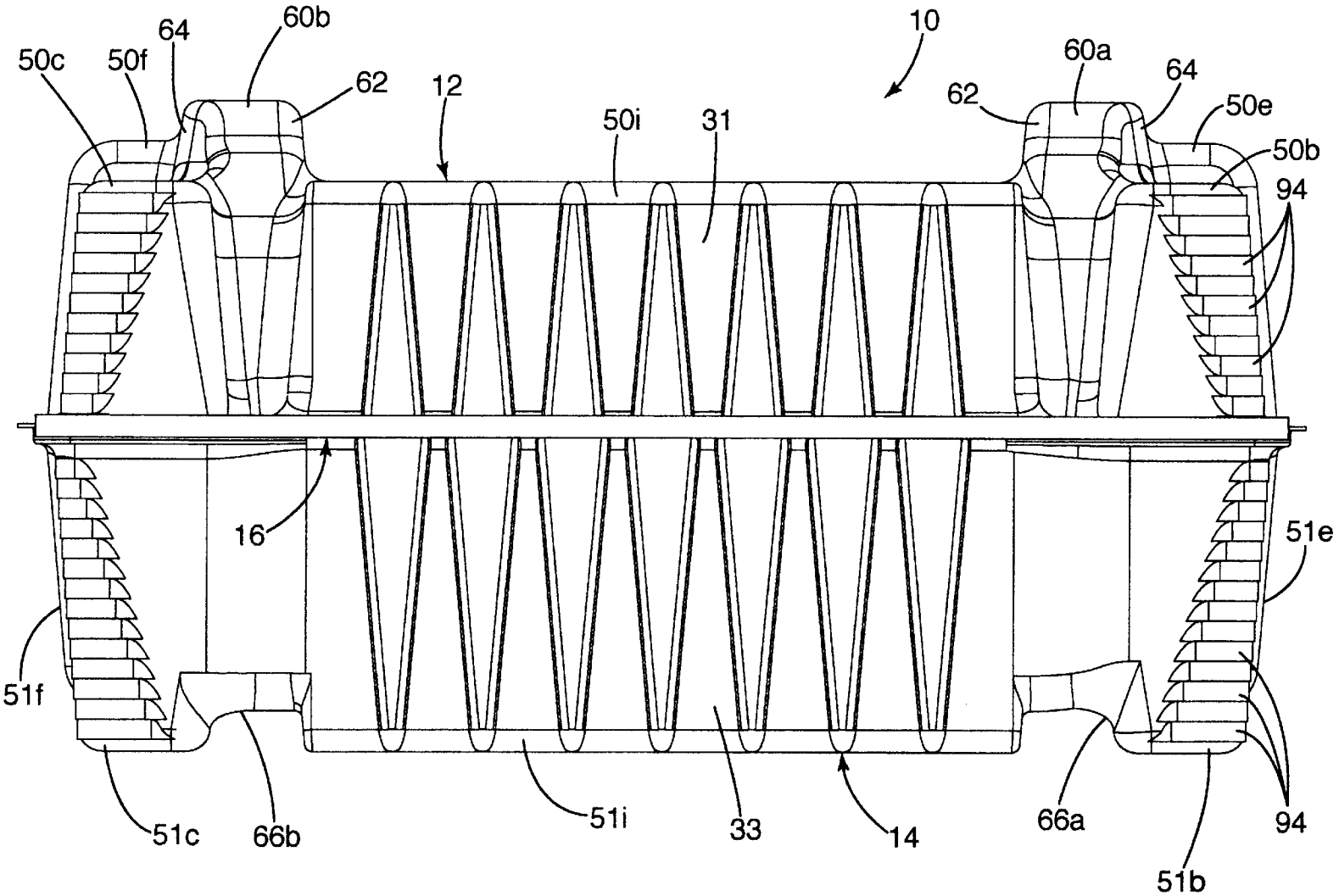
FIG. 7 is a rear elevational view of the fragility package.

A fragility package manufactured in accordance with a preferred embodiment of the present invention is illustrated in FIG. 1 and generally designated 10. The package 10 includes a pair of shell halves 12 and 14 that are joined together along hinge 16 (See FIG. 3). In use, the shell halves are closed together to contain an article A. For purposes of disclosure, the present invention is described in connection with a package specifically designed for use in packaging a computer printer. The present invention is well suited for use in packaging other articles that require fragility packaging, and one of ordinary skill in the art will be capable of readily modifying the package for use with such other articles. As used herein, the terms "inner" and "outer" are used to refer to the directions inwardly and outwardly of the package when the package is closed. Similarly, the terms "front," "rear," "top" and "bottom" are used denote relative positions when the package is closed.

The package 10 is a clamshell package including top and bottom shell halves 12 and 14, respectively, that are connected to one another along hinge 16. The shell halves 12 and 14 may be configured in other than top and bottom pairs. For example, the shell halves may alternatively be left and right shell halves. The shell halves 12 and 14 and hinge 16 are preferably integrally formed as a single, one-piece unit. Alternatively, the shell halves 12 and 14 may be separate, unconnected components, if desired. Each shell half 12 and 14 includes an envelope portion 20 and 22 and a plurality of fragility supports. The envelope portions 20 and 22 cooperate to define an envelope 28 which in turn defines a void 29 for receiving the article A. The envelope 28 may also be shaped to receive any accessories, such as document support trays, cords, manuals, printer cartridges, etc (not shown). The envelope portions 20 and 22 are shaped to closely follow at least a portion of the profile of the article A on all six sides (i.e. top, bottom, left, right, front and back). Accordingly, the envelope 28 entraps the article A preventing it from shifting within the package 10. In applications where the article has the appropriate shape, it may be possible for the envelope to engage the article on less than six sides and still prevent it from shifting within the package.

The envelope portion 20 of top shell half 12 includes top 30, front 32, left 36 and right 38 panels that closely follow the contours of the article A at various locations. These panels are cooperatively defined by various portions of the top shell half 12, for example, with reference to FIG. 3, the top panel 30 is defined in part by a plurality of surfaces $S_{1-9}$. The envelope portion 20 of the top shell half 12 also includes a portion 31 that defines the upper half of an accessory compartment 35 in the rear of the package 10. The envelope portion 20 of bottom shell half 14 includes front 42, left 46 and right 48 panels that closely follow the contours of the article A, as well as bottom panel 40 that closely follows the contours of the article A and defines a lower compartment 70 for receiving certain accessories to be packaged with the article A. In this embodiment, the bottom panel 40 includes a generally U-shaped protrusion 41 to receive a document support rack (not shown) for the article A. The envelope portion 22 also includes a portion 33 that defines the lower portion of the accessory compartment 35 at the rear of the package 10 for holding cords, manuals and other related accessories. The configuration of the envelope will vary from application to application depending primarily on the shape of the article and any related accessories.

In the described embodiment, the top 12 and bottom 14 shell halves each include a strap recess, which permits the package to be secured in the closed position by conventional strapping if desired, such as a plastic binding strap (not shown). More specifically, the top shell half 12 defines strap recesses 90*a* and 90*b*, and the bottom shell half 14 defines strap recesses 92*a–c*.

The top shell half 12 and bottom shell half 14 each include fragility supports 50 that help to protect the article A from impact. The supports 50 extend outwardly from the envelope 28 a substantial distance and are adapted to deform under impact. For purposes of this disclosure, the region between the outermost extent of the supports and the article A is referred to as the "crush zone." The supports 50 are free to flex and deform in the crush zone without damaging the article A. Deformation and flex of the supports 50 within the crush zone absorbs energy from an impact reducing the likelihood of damage to the article A. The top shell half 12 includes nine fragility supports 50. Each support 50 is a vertically extended pillar having a substantially planar upper surface 52. The supports 50 are tapered inwardly from bottom to top, primarily to provide sufficient draft to permit the package to be removed from the mold after molding. The first four supports 50*a–d* of the top shell half 12 are disposed in the four corners of the top shell half 12. The corner supports 50*a–d* preferably include a plurality of scallops or ridges 94 that function to strengthen the corner supports 50*a–d*. As shown, the ridges 94 are preferably arranged in parallel rows extending horizontally along the outer surfaces of each corner support 50*a–d*. The remaining supports 50*e–i* of the top shell half 12 are disposed along the front, rear and side surfaces of the top shell half 12. The upper surfaces 52 of the supports 50*a–i* terminate in an arrangement that is complementary to the lower surfaces 54 of the supports 51*a–i* so that packages can be stably stacked one atop the other. For example, the upper surfaces 52 of supports 50*a–d* and 50*g–i* terminate in a common plane while the upper surfaces 52 of supports 50*e–f* terminate above that plane.

Like the top half 12, the bottom shell half 14 includes nine fragility supports 51*a–i*, each being a vertically extended pillar having a substantially planar lower surface 54. The supports 51*a–i* of the bottom shell half 14 correspond in size, shape and location with the supports 50*a–i* of the top shell half 12. The supports 51*a–i* are, like supports 50*a–i*, tapered inwardly from top to bottom. The first four supports 51*a–c* of the bottom shell half 14 are disposed in the four corners of the bottom shell half 14 immediately below the corresponding corner supports 50*a–i* of the top shell half 12. The remaining supports 51*e–i* of the bottom shell half 14 are disposed along the front, rear and sides of the bottom shell half 14 immediately below the corresponding supports 50*e–i* of the top shell half 12. The lower surfaces 54 of the supports 51*a–i* terminate in an arrangement that compliments or corresponds with the arrangement of the upper surfaces 52 of the corresponding supports 51*a–i*. The supports 51*a–d* and 51*g–h* terminate in a common plane to rest upon the ground or other planar surface. The configuration of the supports 50*a–i* and 51*a–i* presented in the described embodiment is merely exemplary. The size, shape, number and location of supports will vary from application depending in large part on the size, shape and weight of the article to be packaged.

Figure 8:
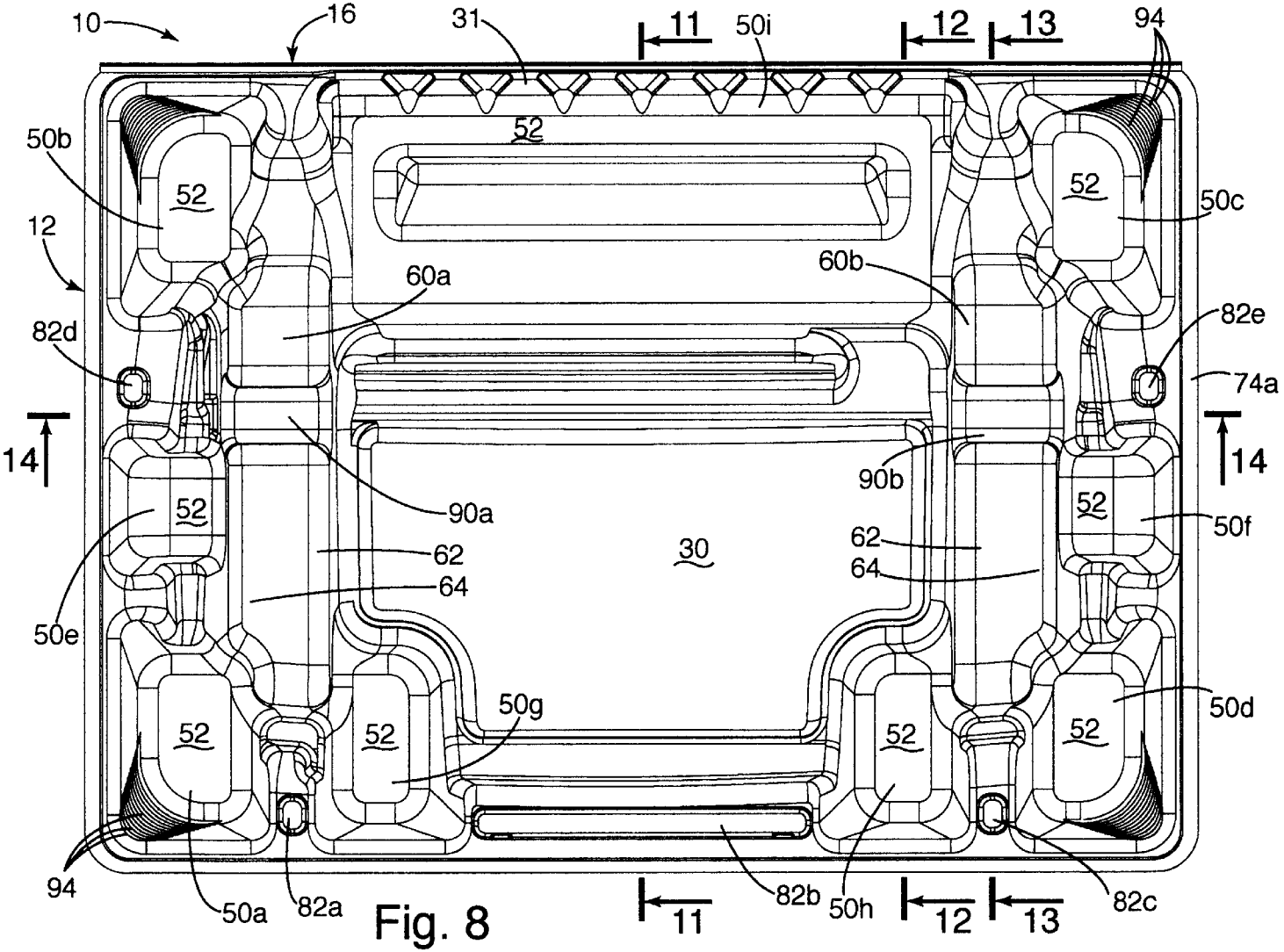
FIG. 8 is a top plan view of the fragility package.
Figure 9:
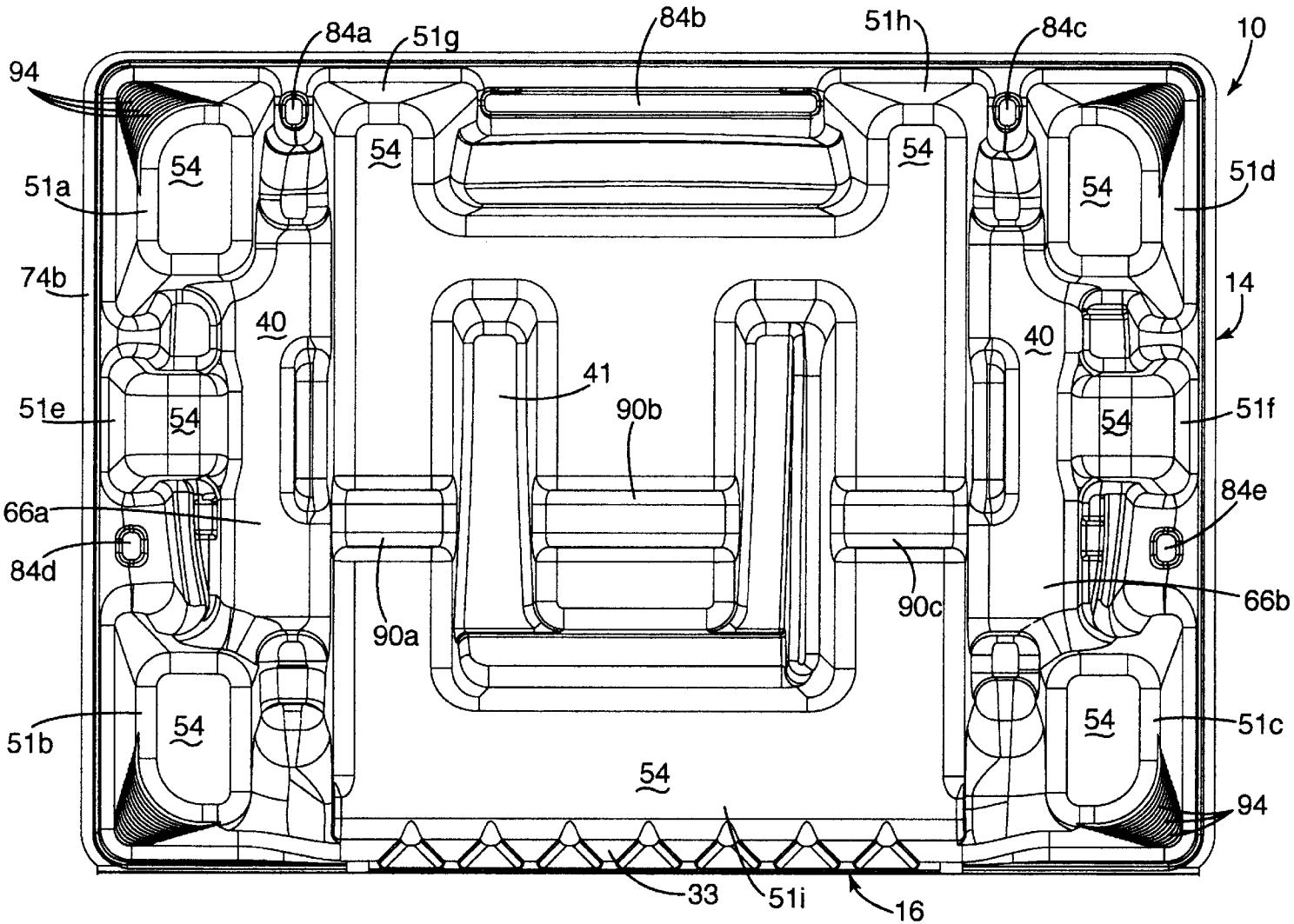
FIG. 9 is a bottom plan view of the fragility package.
Figure 10:
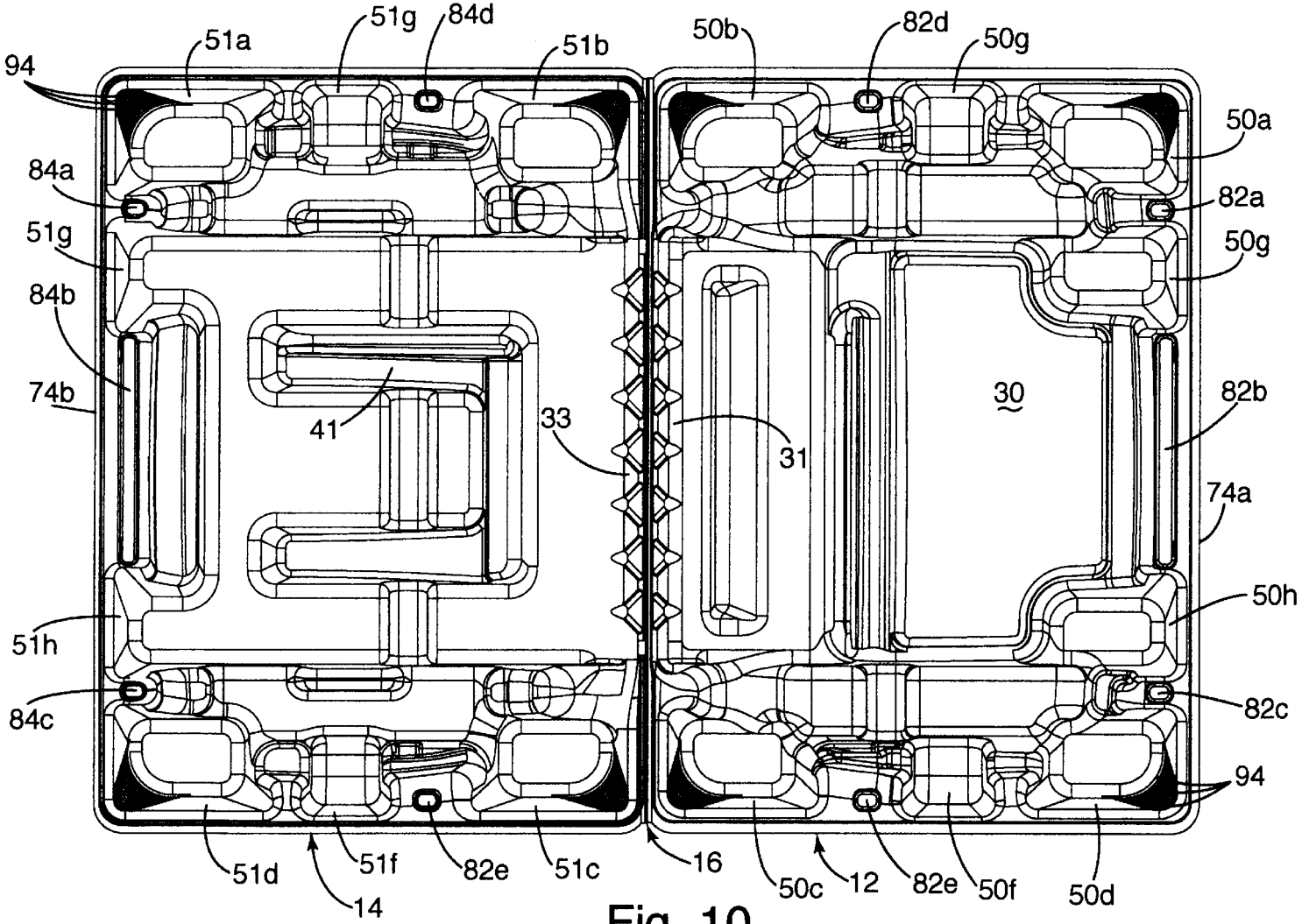
FIG. 10 is a top plan view of the fragility package in the open position.
Figure 11:
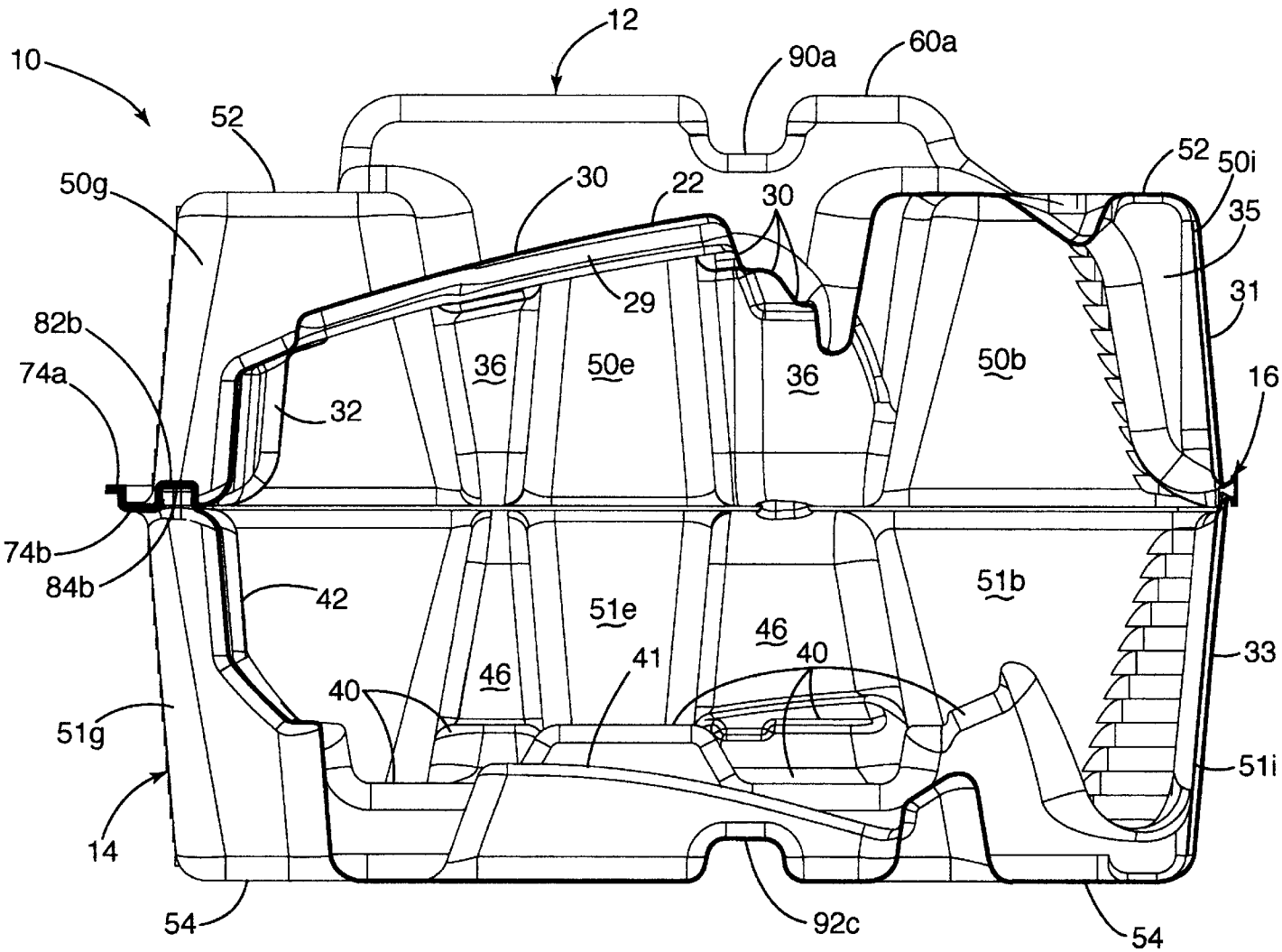
FIG. 11 is a sectional view of the fragility package taken along line XI—XI of FIG. 8.
Figure 12:
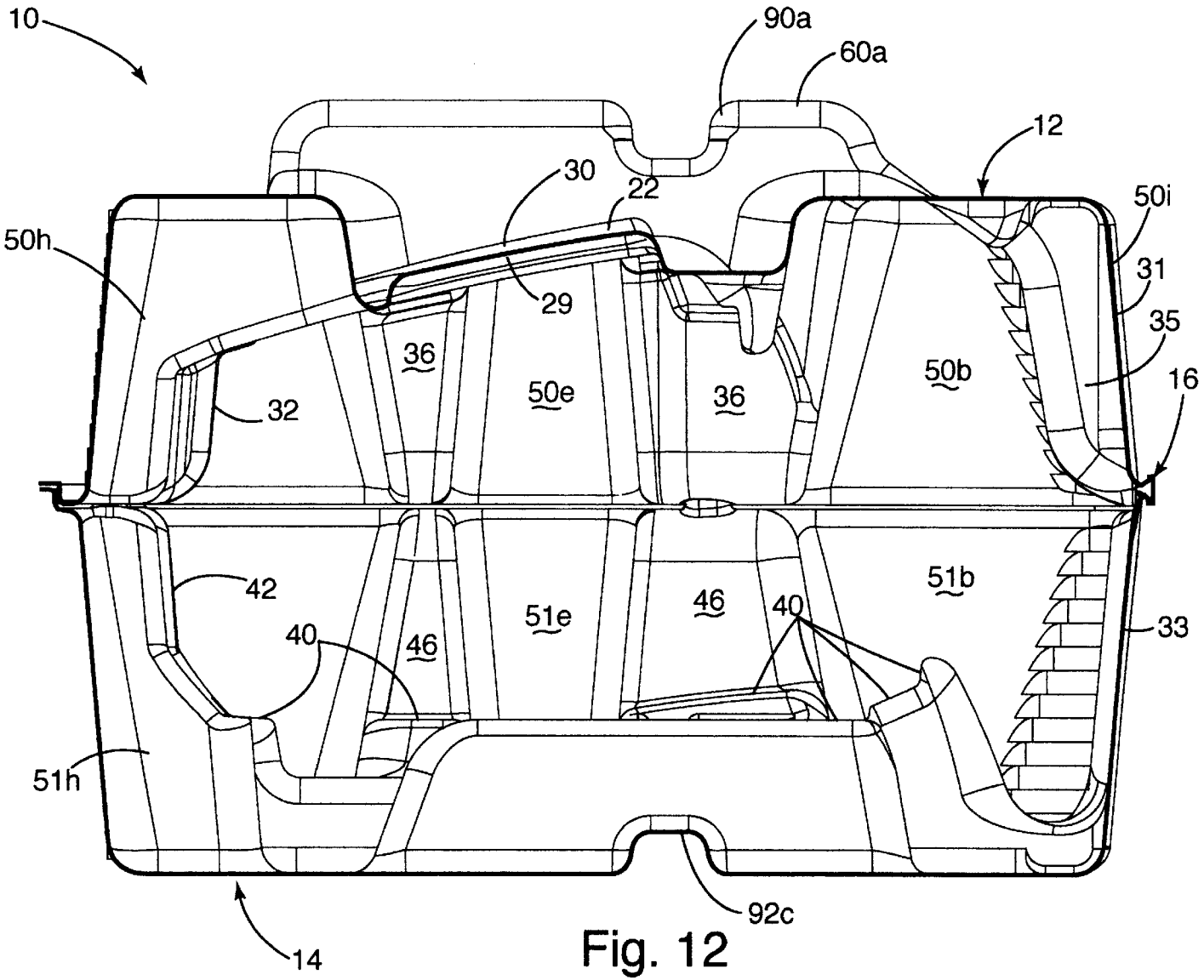
FIG. 12 is a sectional view of the fragility package taken along line XII—XII of FIG. 8.

The top shell half 12 further includes a pair of nesting protrusions 60*a–b*. The nesting protrusions 60*a–b* extend laterally across the top shell half 12 upwardly from and between the corner supports 50*a–d* and the adjacent supports 50*g–i*. As with the fragility supports 50*a–i* and 51*a–i*, the nesting protrusions 60*a–b* are tapered to provide sufficient draft for the package 10 to be removed from the mold. Each nesting protrusion 60*a–b* is somewhat T-shaped having a main portion 62 and an interlocking portion 64 (See FIG. 8). The nesting protrusions 60*a–b* are adapted to fit within corresponding voids 66*a–b* in the bottom shell half 14 of an above stacked package (See FIG. 9). When nested, the primary function of the main portion 64 is to prevent stacked packages from shifting left and right with respect to one another and the primary function of the interlocking portion 64 is to prevent stacked packages from shifting forwardly and rearwardly with respect to one another.

Figure 13:
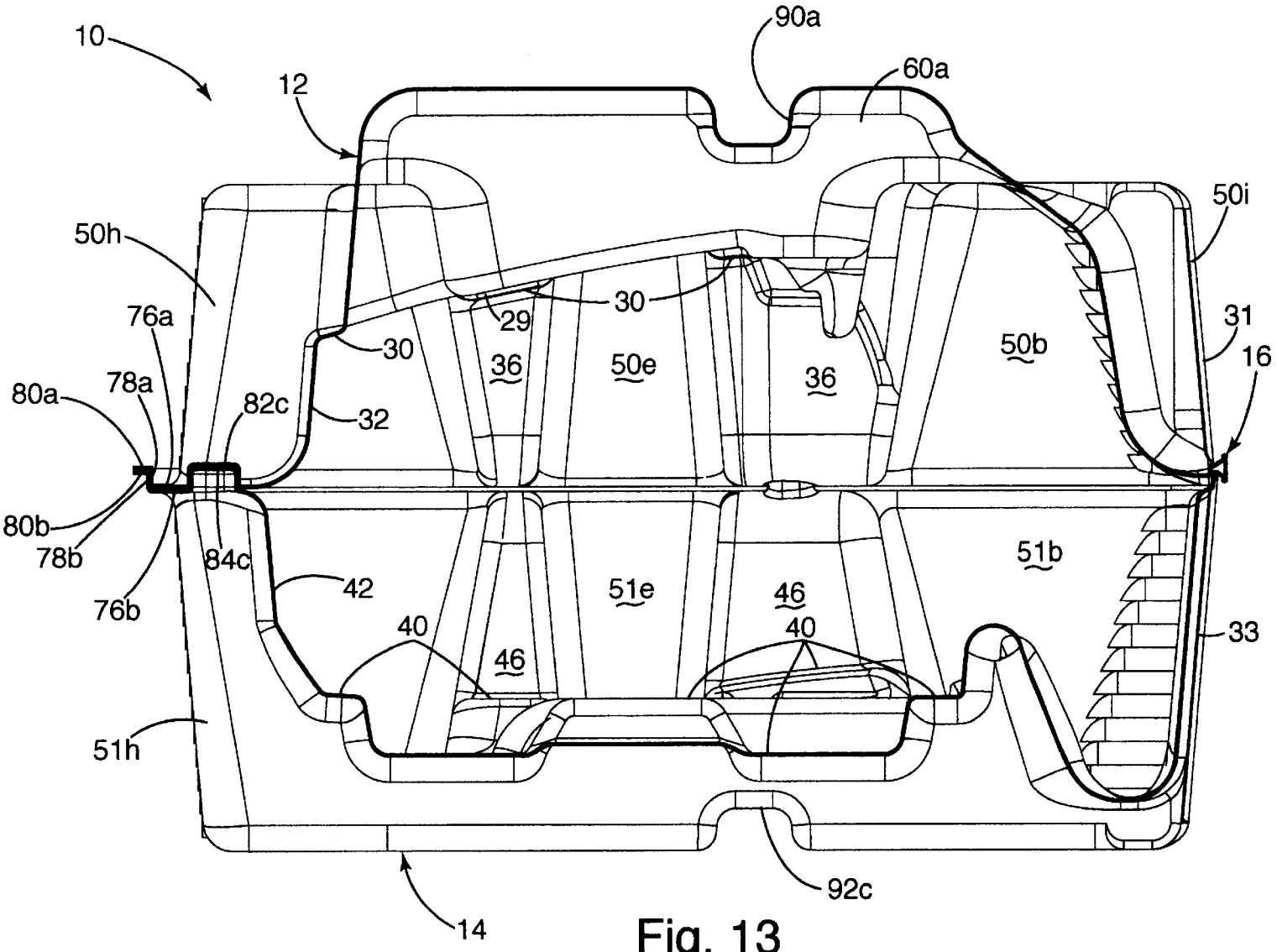
FIG. 13 is a sectional view of the fragility package taken along line XIII—XIII of FIG. 8.
Figure 14:
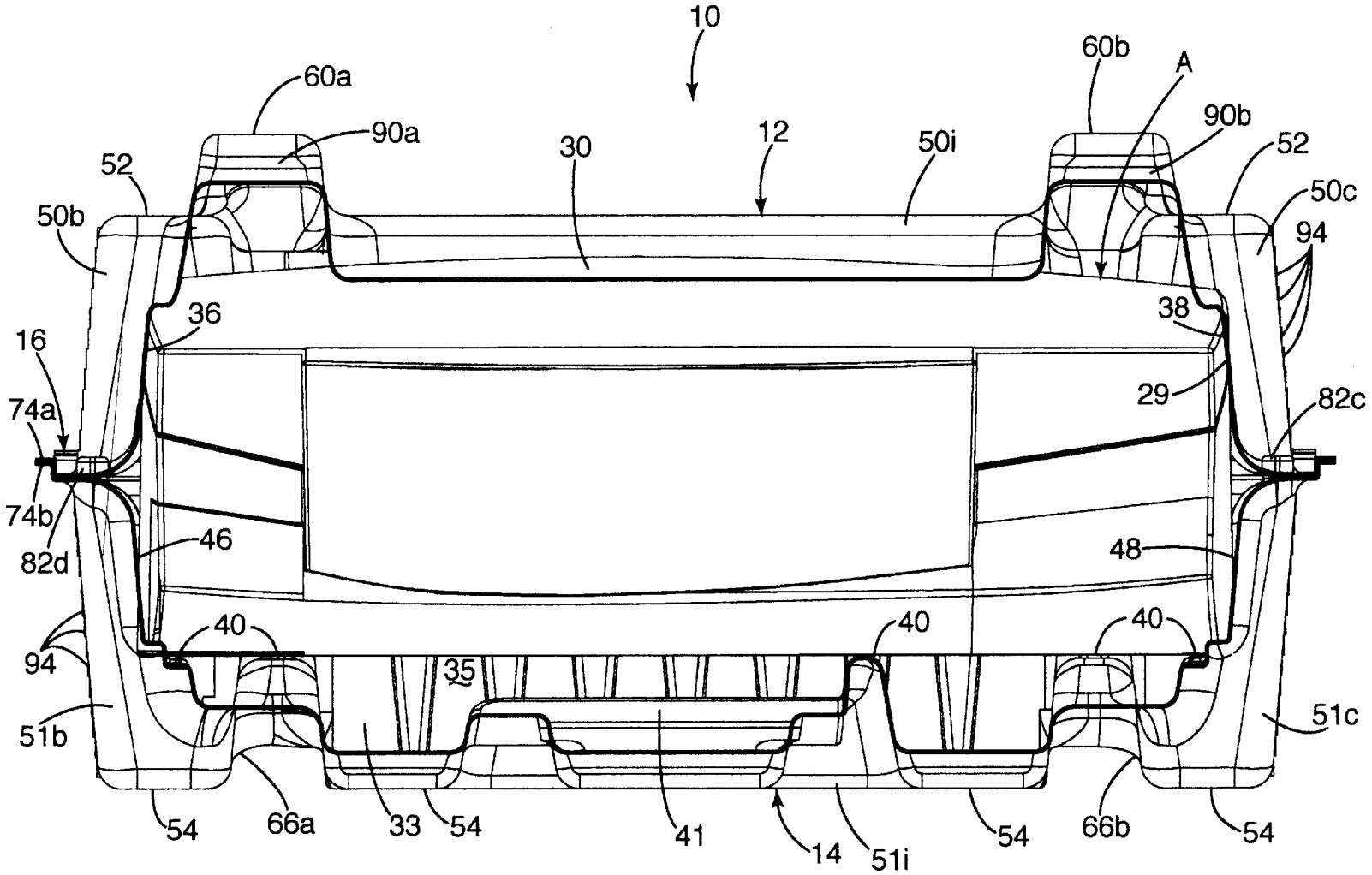
FIG. 14 is a sectional view of the fragility package taken along line XIV—XIV of FIG. 8 showing the article in the package.
Figure 15:
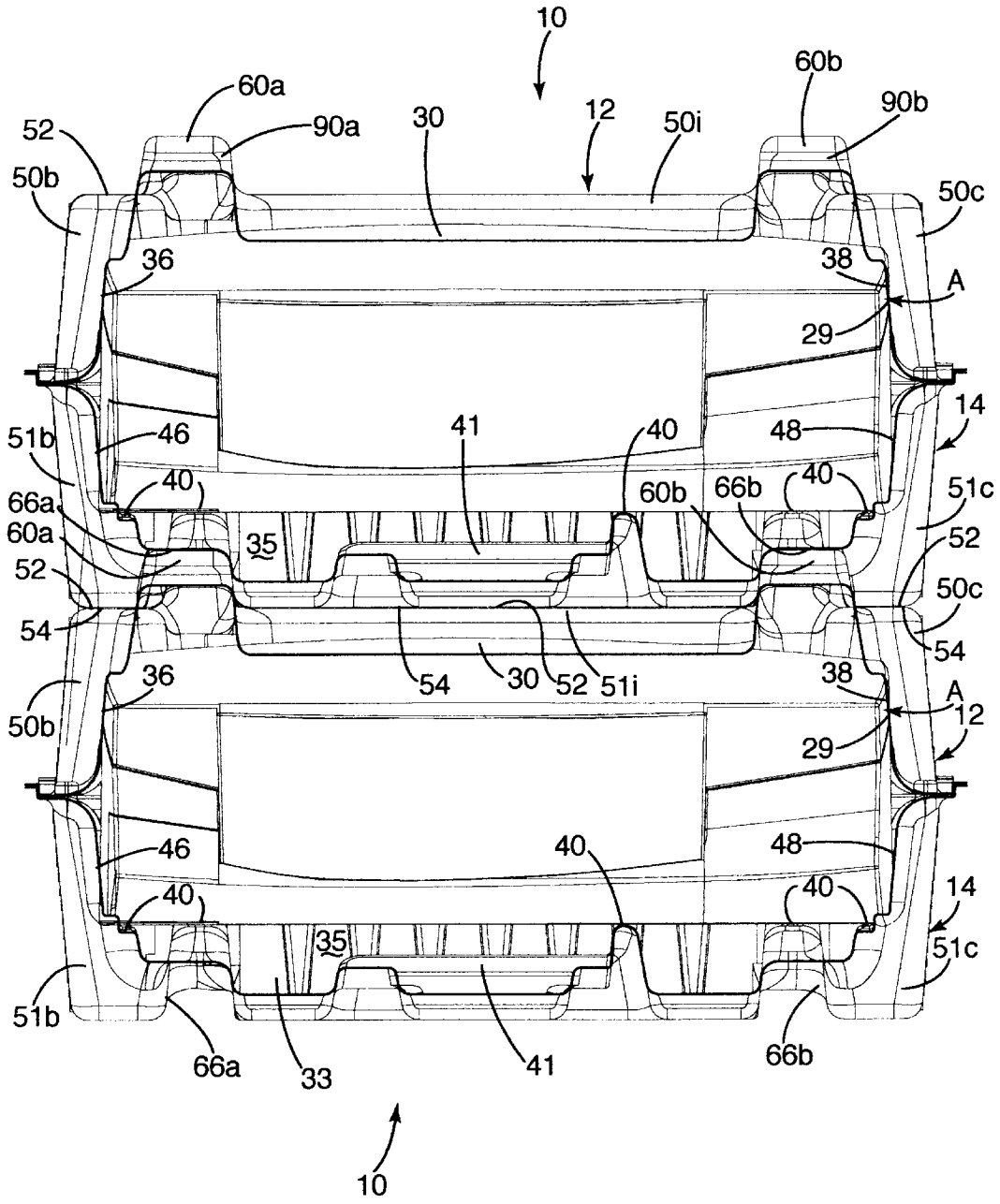
FIG. 15 is a sectional view of two stacked fragility packages taken along line XIV—XIV of FIG. 8 showing articles in the packages.
Figure 16:
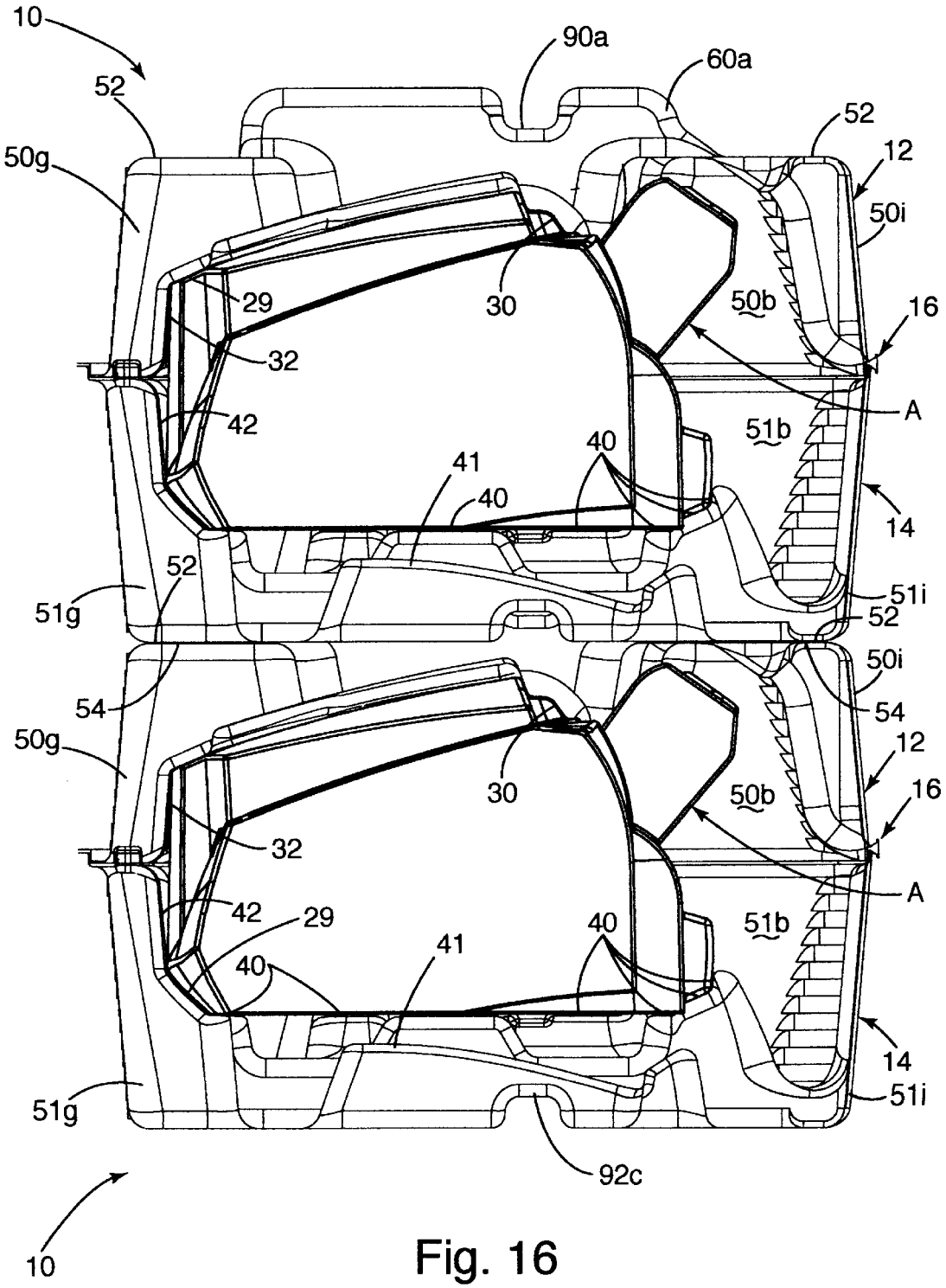
FIG. 16 is a sectional view of two stacked fragility packages taken along line XI—XI of FIG. 8 showing articles in the packages.
Figure 17:
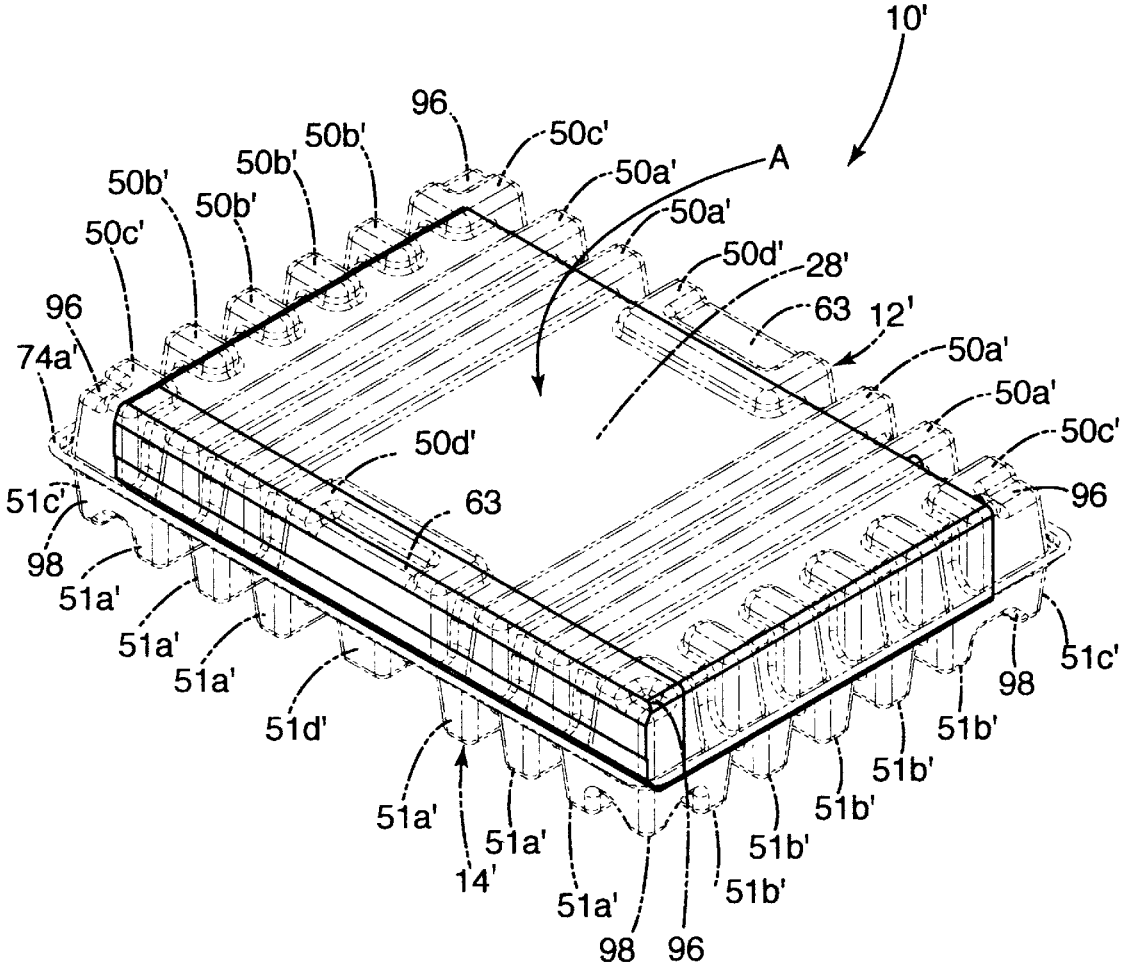
FIG. 17 is a perspective view of an alternative embodiment of the package showing an article therein.
Figure 18:
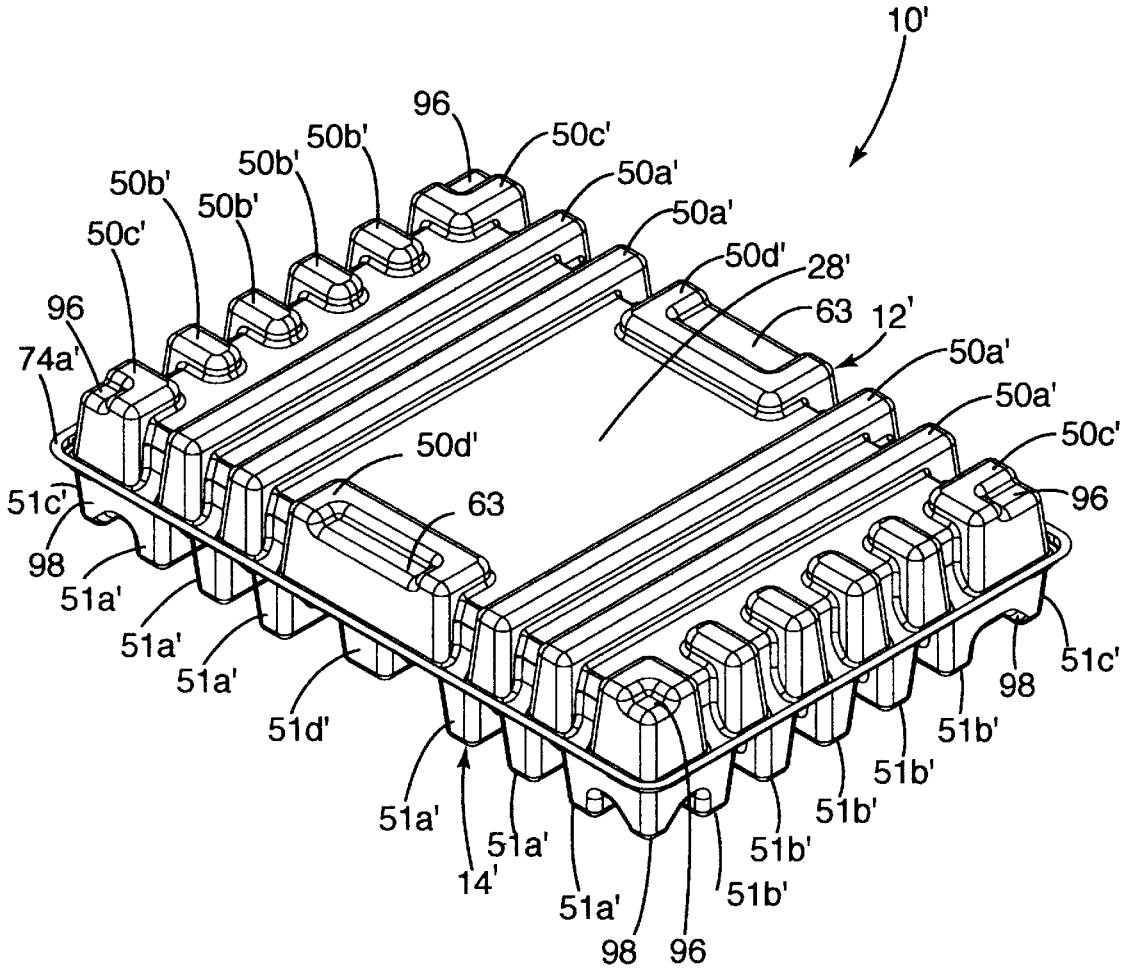
FIG. 18 is a second perspective view of the alternative package.
Figure 19:
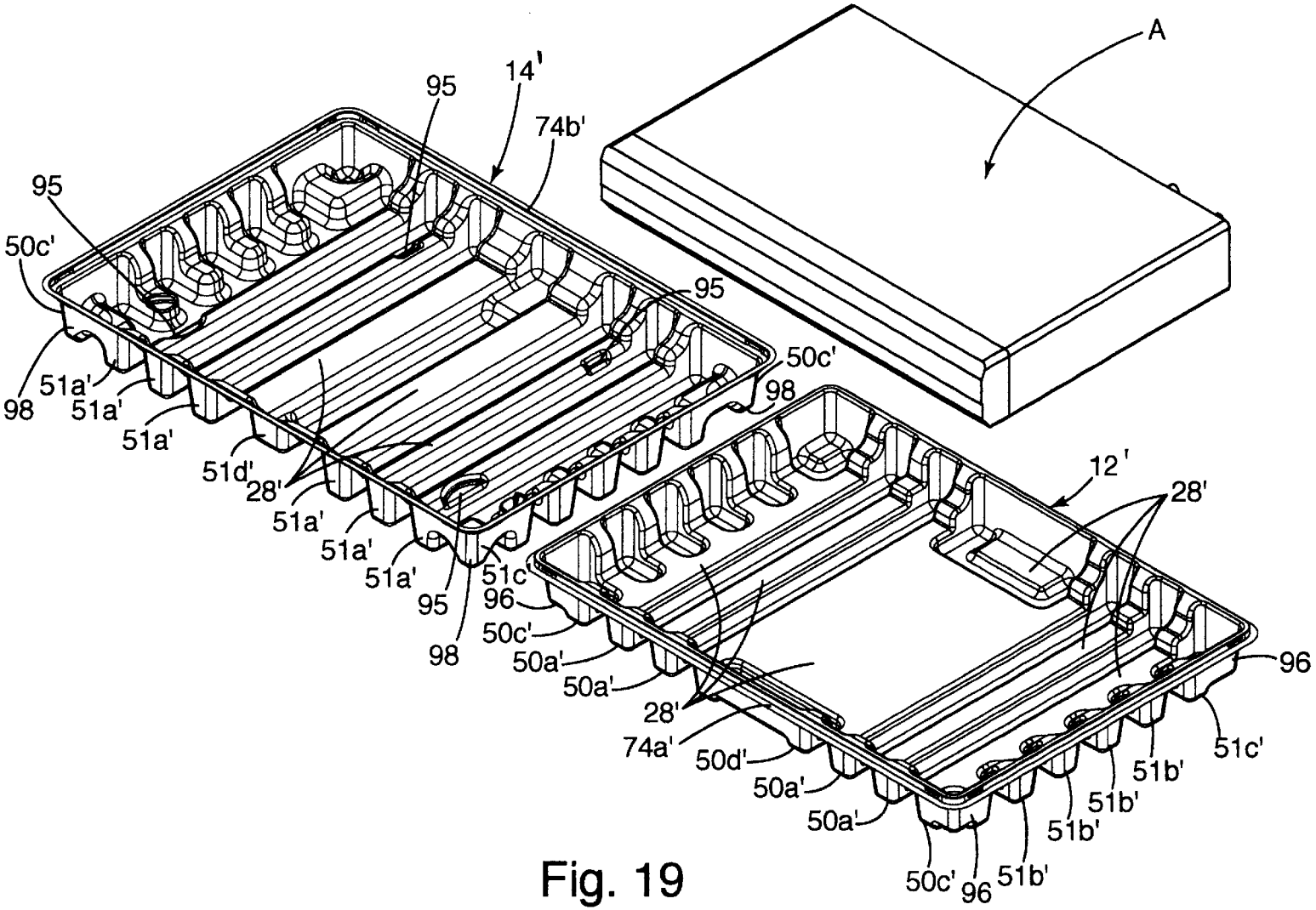
FIG. 19 is an exploded perspective view of the alternative package showing the article and the shell halves in the open position.
Figure 20:
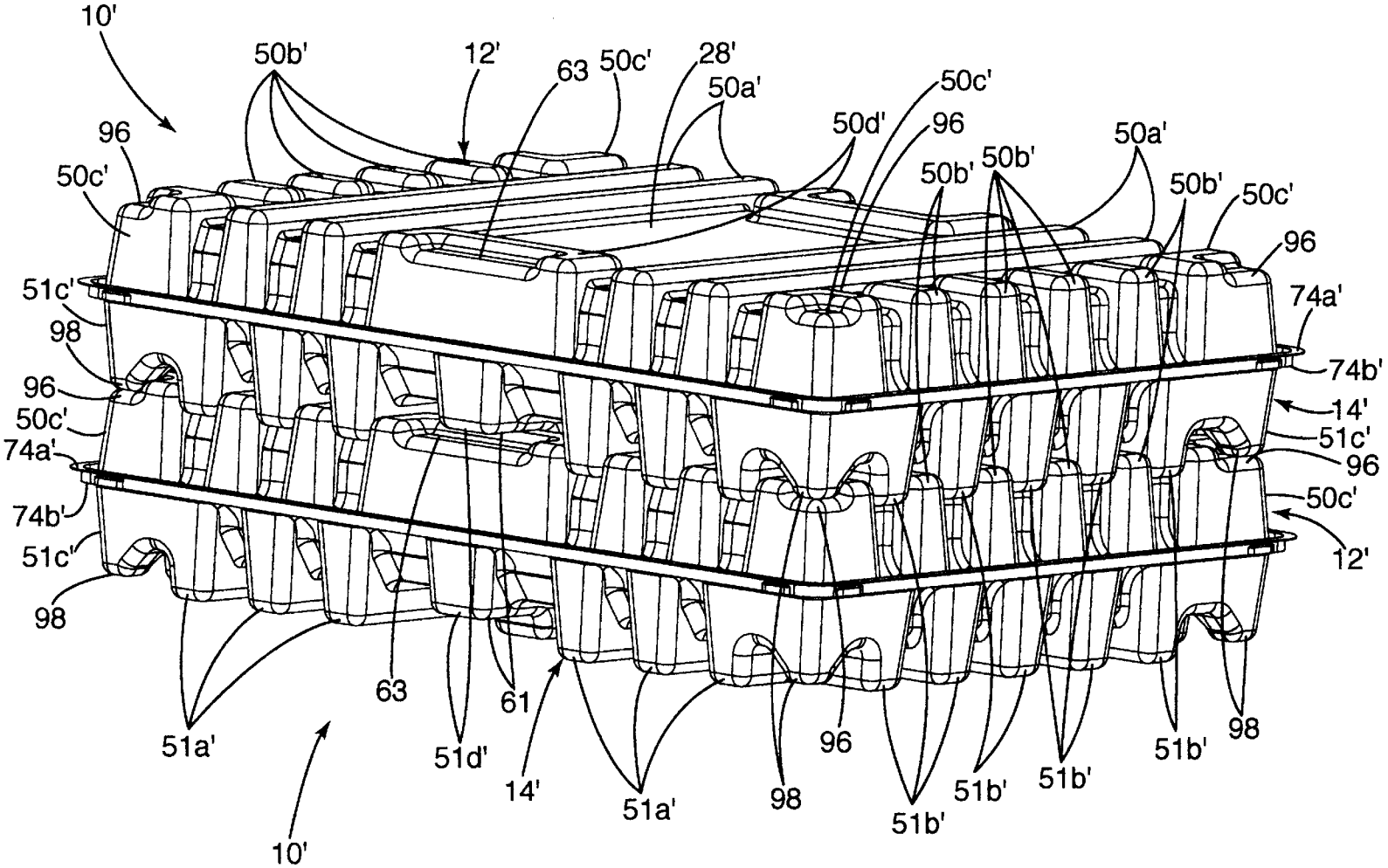
FIG. 20 is a top perspective view showing two alternative packages stacked one atop another.
Figure 21:
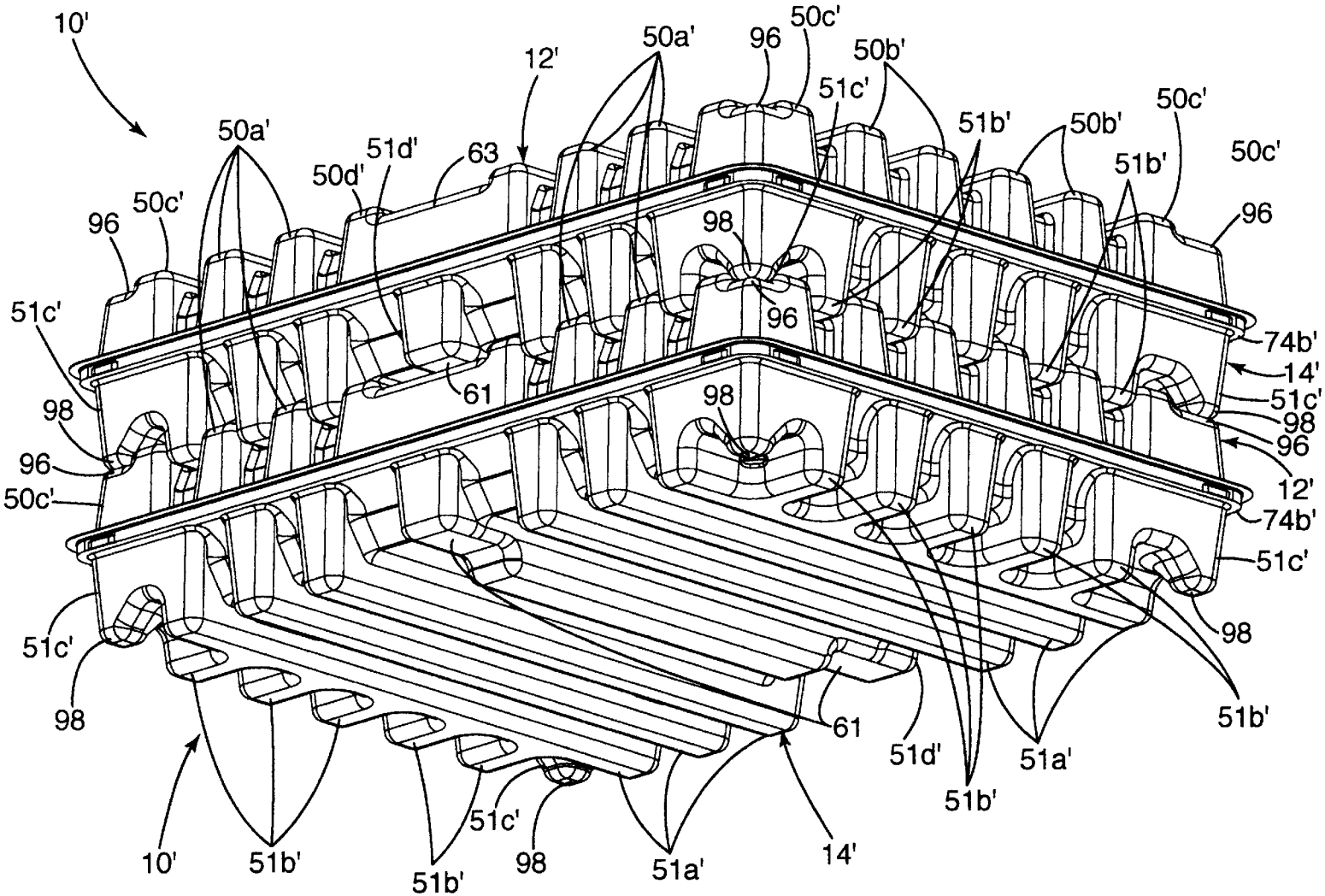
FIG. 21 is a bottom perspective view showing two alternative packages stacked one atop another.

The top and bottom shell halves 12 and 14 each include a peripheral flange 74*a–b*. The flanges 74*a–d* extends entirely around the respective shell halves 12 and 14 and engage one another when the package 10 is closed. Hinge 16 extends between and interconnects the flanges 74*a–b* along the rear of the package 10. Each flange 74*a–b* includes a substantially horizontal bottom wall 76*a–b*, an intermediate wall 78*a–b* extending substantially vertically from the bottom wall 76*a–b*, and a top wall 80*a–b* extend substantially horizontally from the intermediate wall 78*a–b* (See FIG. 13). The flanges 74*a–b* strengthens the package 10 and provides a pair of mating surfaces that may be intersecured, such as by plastic welding, to seal the package 10 in the closed position.

The top and bottom shell halves 12 and 14 also include a plurality of interlocking ribs 82*a–e* and 84*a–e*. The top shell half 12 includes three ribs 82*a–c* located across its front as well as a single rib 82*d–e* located on each of its left and right sides. The bottom shell half 14 includes a plurality of ribs 84*a–e* that correspond and fit within the ribs 82*a–e* of the top shell half 12. The ribs 82*a–e* are adapted to snap-fit into engagement with the corresponding ribs 84*a–e* when the package 10 is closed.

The package 10 is manufactured using conventional vacuum molding techniques and apparatus. The package 10 is preferably manufactured from a polymer of sufficient strength and thickness to withstand the desired level of impact. For example, the package 10 may be manufactured from polyethylene terephthalate (PET), polyvinyl chloride (PVC) or other similar polymers. To provide a more flexible package and reduce the likelihood of cracking, the polymer may include impact modifiers, softeners and other conventional additives, which are selected to provide the particular characteristics desired for each application. One class of impact-modified polymers found to be suitable for this application is polyethylene terephthalate (PET) with conventional impact modifiers. A specific impact-modified polymer found to be particularly well-suited for this application is available from Kama Corporation of Hazleton, Pennsylvania under the name Impact Modified RPET. In the disclosed embodiment, this material has a thickness of approximately 40 mil or 40 thousandths (0.04) of an inch. As will be readily understood by one of ordinary skill, the package can be manufactured from a wide variety of polymers in a wide variety of thicknesses, as dictated in large part by the particular application.

The article A is preferably packaged using conventional techniques and apparatus. First, any accessories, such as manual, power cords, etc, are placed within the open package 10 within compartment 35. This can be done manually or using conventional automated packaging equipment (not shown). Next, the article A is placed within the open package 10 within envelope portion 20 of the bottom shell half 14. The package 10 is then closed with the ribs 82*a–e* and 84*a–e* snap-fitting to retain the package 10 in the closed position. The package 10 is sealed using conventional techniques and apparatus, such as conventional plastic welding techniques and apparatus. For example, the package 10 can be sealed using RF welding. As an alternative or in addition to plastic welding, the flanges 74*a–b* can be secured by adhesives, mechanical fasteners or be formed to snap-fit together. As a further alternative or in addition to any of the aforementioned, the package 10 can be sealed using a binding strap (not shown). The strap can be wrapped around the package 10 in strap recesses 90*a–b* and 92*a–c* and secured to itself to hold the package closed.

Alternative Embodiment

An alternative embodiment of the present invention is illustrated in FIGS. 17–24. This embodiment is designed to package an article A' having different size, shape and weight than the article A of the embodiment described above. As shown, the packaged article A' is substantially rectangular in shape and is entrapped within an envelope 28', much like the embodiment described above. Unless otherwise described or shown in the FIGS., the package 10' is generally identical to package 10. One of the primary distinctions between package 10' and package 10 is that the fragility supports also function to interlock adjacent stacked packages. In contrast, package 10 includes separate nesting protrusions 60*a–b* and voids 66*a–b*. The package 10' includes separate top and bottom shell halves 12' and 14', respectively. The shell halves 12' and 14' each include a plurality of fragility supports 50' and an envelope 28' that is recessed in all directions from the outermost extreme of the supports 50'. The envelope 28' is essentially rectangular and is shaped to closely follow the contours of the article A' such that the article A' is held in place within the package 10'. The envelope 28' may include various contours to match the precise shape of the article A', such as recesses 95 in the bottom shell half 14' which correspond with and receive the feet (not shown) of the article A' (See FIG. 19). A plurality of support 50*a'* and 51*a'* extend transversely across the top and bottom of the package 10' from its front to its rear. These transverse supports 50*a'* and 51*a'* extend around the front and rear of the package 10' to flanges 74*a'* and 74*b'*. The top transverse supports 50*a'*are laterally offset from the bottom transverse supports 51*a'* so that the top and bottom supports interlock when two packages are stacked one atop the other. As a result of the configuration of the top and bottom supports, adjacent packages can be stacked in a laterally offset arrangement, and need not be stacked directly atop one another (See FIGS. 22 and 24). This permits the packages to be uniquely stacked at the point of sale, for example, in a pyramid or other arrangement.

The package 10' also includes a series of side supports 50*b*' and 51*b*' that protrude in a longitudinal direction along opposite sides of the package 10'. These supports 50*b*' and 51*b*' extend around the upper and lower corners of the top and bottom shell halves 12' and 14', respectively, to flanges 74*a*' and 74*b*'. The top side supports 50*b*' are laterally offset from the bottom side supports 51*b*' so that the supports interlock when two packages are stacked one atop the other (See FIGS. 20, 21 and 23). As perhaps best shown in FIG. 21, the bottom side supports 51*b*' extend to and merge with the outermost transverse supports 51*a*'.

The package 10' further includes a corner support 50*c*' and 51*c*' located in each corner of the package 10'. The corner supports 50*c*' and 51*c*' wrap around the corners to flanges 74*a*' and 74*b*'. The top corner supports 50*c*' and configured to nest with the bottom corner supports 51*c*' when two packages are stacked. As perhaps best shown in FIGS. 20 and 21, the top corner supports 50*c*' each define a recess 96 adapted to receive a protrusion 98 extending from the corresponding bottom corner support 51*c*'.

Figure 22:
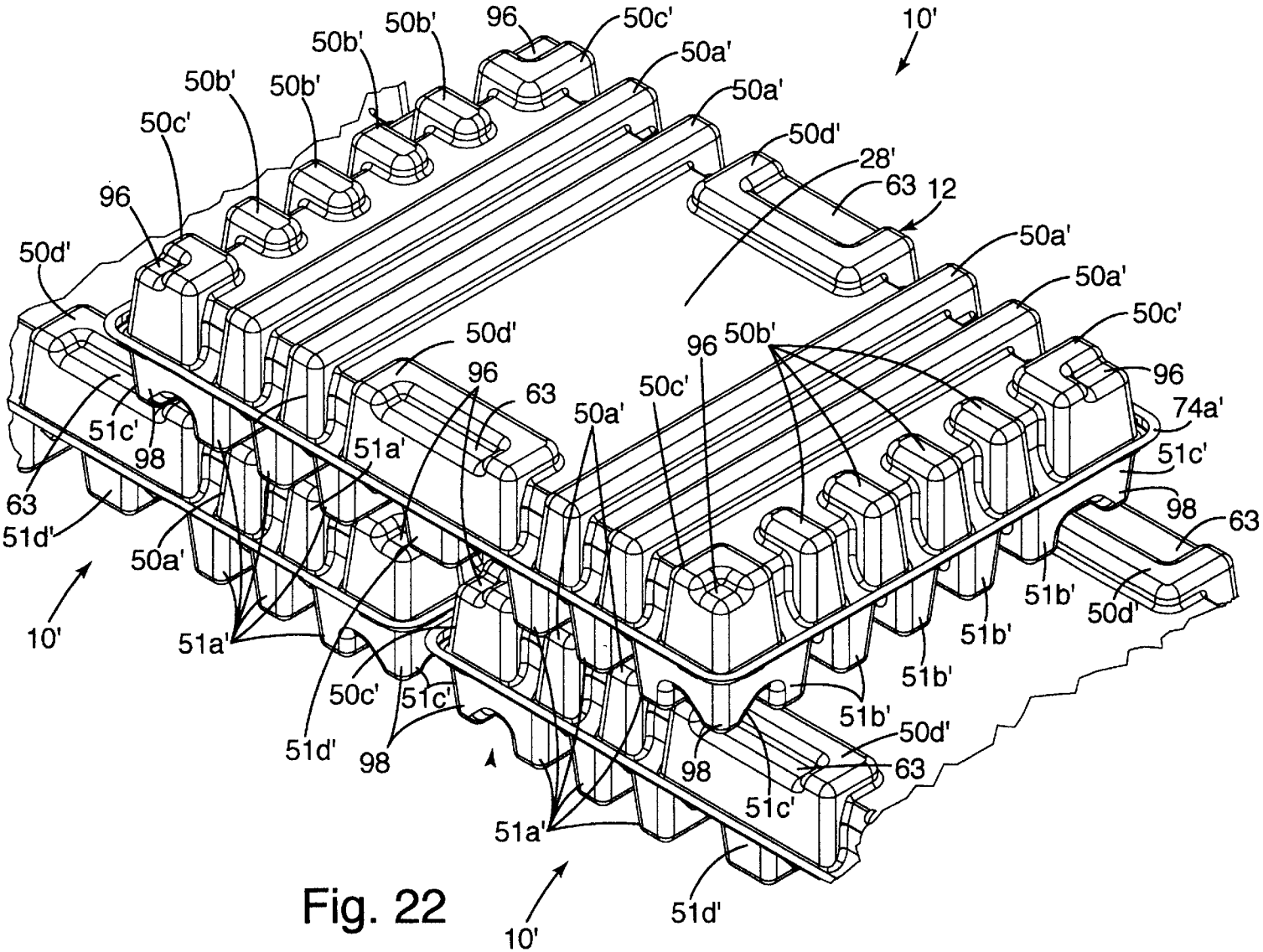
FIG. 22 is a partial perspective view showing a single alternative package stacked atop two alternative packages.
Figure 23:
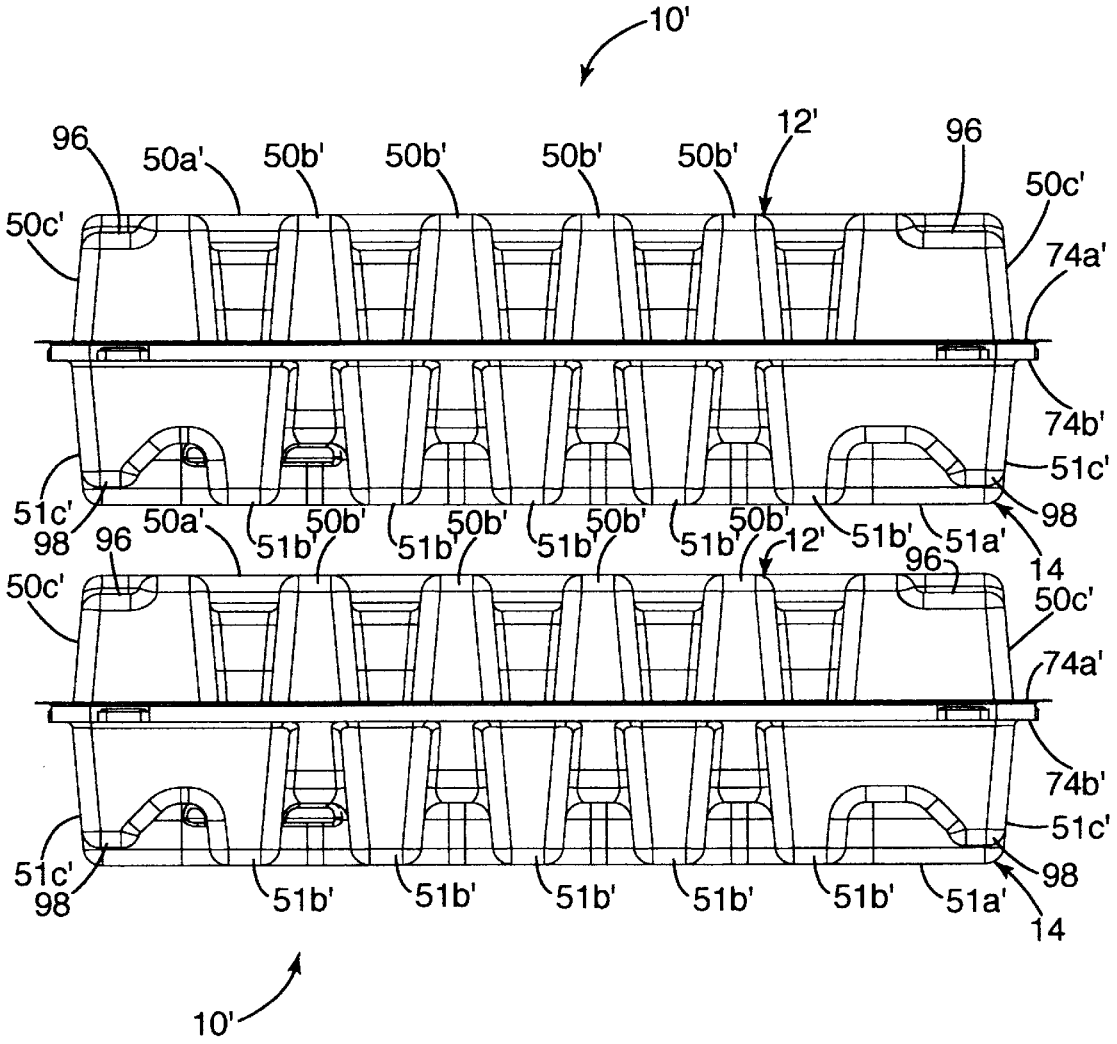
FIG. 23 is a right side elevational view of two alternative packages showing the alignment of the supports.
Figure 24:
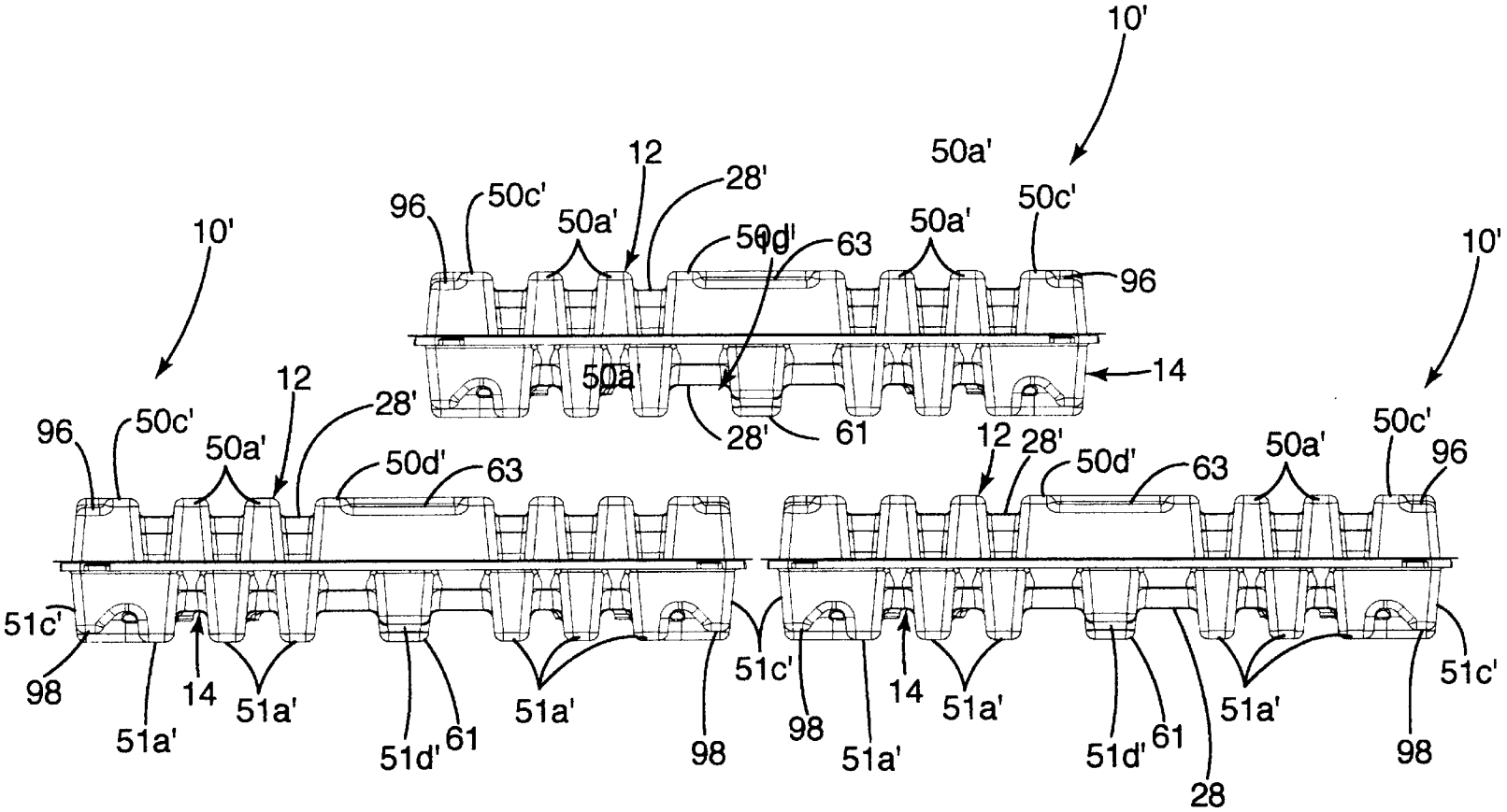
FIG. 24 is front elevational view of three packages showing the alignment of the supports.

Finally, the package 10' includes a plurality of center supports 50*d*' and 51*d*'. The top shell half 12' defines a pair of center supports 50*d*' that wrap around the front and rear of the package 10' to flange 74*a*'. Each center support 50*d*' defines a recess 63 adapted to receive a protrusion 98 extending from the corresponding bottom corner support 51*c*' when two packages are stacked in an offset configuration as shown in FIGS. 22 and 24. The bottom shell half 14' includes a single center support 51*d*' that extends transversely across the bottom of the package 10' from its front to its rear. This center support 51*d*' extends around the front and rear of the package 10' to flange 74*b*'. The center support 51*d*' includes recesses 61 at opposite ends thereof. The recesses 61 are configured to nest between the center supports 50*d*' of the top half when two packages are stacked directly atop one another (See FIGS. 20 and 21).

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A fragility package for packaging an article comprising:

top and bottom shell halves;

a hinge integrally formed with and interconnecting said top and bottom shell halves, said hinge permitting said top and bottom shell halves to be selectively moved between open and closed positions;

said top and bottom shell halves cooperatively defining an envelope for containing the article when in said closed position, said top and bottom shell halves including a plurality of fragility supports extending outwardly from said envelope to protect the article from impact, said fragility supports including outer interlocking nesting protrusions and recesses and central interlocking nesting protrusions and recesses, such that a plurality of packages may be stacked in an offset configuration.

2. The package of claim 1 wherein said package is manufactured from a transparent impact-modified polymer that resists impact and permits the article to be visually inspected.

3. The package of claim 2 wherein said top shell half and said bottom shell half each include a plurality of corners, one of said top shell half and said bottom shell half includes a corner supports having said outer interlocking nesting protrusion and the other of said top shell half and said bottom shell half includes corner supports having said outer interlocking recess, one of said top shell half and said bottom shell half includes said central interlocking nesting protrusion and the other of said top shell half and said bottom shell half includes said central interlocking recess, such that when a pair of said packages are stacked in an offset configuration said protrusions on said corner supports of one of said packages will nest within said recess on said center supports of the other of said packages.

4. The package of claim 3 wherein said top and bottom shell halves define a plurality of transverse supports, said transverse supports on said top shell half being laterally offset from said transverse supports on said bottom shell half.

5. The package of claim 3 wherein each of said plurality of supports includes a top support half defined by said top shell half and a bottom support half defined by said bottom shell half.

6. The package of claim 5 wherein said package includes a top and a bottom when in said closed position, each of said supports extends vertically between said top and said bottom, said envelope being recessed from said top and said bottom.

7. The package of claim 6 wherein said each of said corner supports of said top half includes a top surface, said top surfaces of each of said corner supports of said top half terminating in a common plane.

8. The package of claim 7 wherein each of said corner supports of said bottom half includes a bottom surface, said bottom surfaces of each of said corner supports of said bottom half terminating in a common plane.

9. The package of claim 8 wherein said envelope includes a plurality of panels adapted to closely follow portions of the article to prevent the article from shifting within said package.

10. The package of claim 9 wherein said package includes opposed first and second sides defined by outermost portions of said plurality of supports, said envelope being recessed from said first side and said second side.

11. A combination fragility package and article comprising:

an article;

a top shell half including an envelope portion and a plurality of fragility supports; and a bottom shell half including envelope portion and a plurality of fragility supports, said top shell half and said bottom shell half intersecured about said article to cooperatively define a package containing said article, said envelope portion of said top shell half and said envelope portion of said bottom shell half cooperatively defining an envelope containing said article, said envelope entrapping said article such that said article is incapable of substantial movement within said envelope, said plurality of fragility supports of said top shell half and said bottom shell half extending outwardly from said envelope and having an outermost extent, said envelope and said article recessed from said outermost extent of said plurality of fragility supports of said top shell half and said bottom shell half to define a crush zone outwardly from envelope and said article, said fragility supports on said top shell half being laterally offset from said fragility supports on said bottom shell half such that when two packages are stacked said fragility supports on said bottom shell half of one package are nested with said fragility supports of said top shell half of the other package.

12. The combination of claim 11 one of said top shell half and said bottom shell half includes a nesting protrusion and the other of said top shell half and said bottom shell half includes a corresponding recess such that when a pair of said packages are stacked one atop the other said protrusion of one of said packages will nest within said recess of the other of said packages.

13. The combination of claim 12 wherein said package includes a plurality of corners, said plurality of fragility supports including at least one support disposed in each of said plurality of corners.

14. The combination of claim 13 wherein said plurality of supports extend vertically, each of said plurality of supports of said bottom shell half being vertically offset with a corresponding one of said plurality of supports of said top shell half.

15. The combination of claim 14 wherein each of said plurality of supports of said top shell half disposed in said corners includes a top surface, said top surfaces of each of said plurality of supports disposed in said corners terminating in an upper common plane.

16. The combination of claim 15 wherein each of said plurality of supports of said bottom shell half disposed in said corners includes a bottom surface, said bottom surfaces of each of said plurality of supports disposed in said corners terminating in a lower common plane, said lower common plane being substantially parallel to said upper common plane.

17. The combination of claim 11 wherein each of said top shell half and said bottom shell half are manufactured from an impact-modified polymer.

18. The combination of claim 17 wherein said impact-modified polymer is transparent.

19. A packaged article comprising:

an article having a shape;

a package manufactured from an impact-modified plastic, said package including top and bottom halves, said top and bottom halves being secured about said article, said top and bottom halves cooperatively defining an envelope having a shape corresponding at least in part to said shape of said article, whereby said envelope retains said article stationary within said package, said package including a plurality of supports extending outwardly from said envelope and having an outermost extent, said envelope and said article entirely recessed from said outermost extent of said plurality of supports to define a crush zone surrounding said envelope and said article, said supports of said top half being laterally offset from said supports of said bottom half and being configured such that said supports of said top half are adapted to nest between said supports of said bottom half when two of said packages are stacked vertically one atop another to interlock said two stacked packages.

20. A packaged article comprising:

an article having a shape;

a package manufactured from an impact-modified plastic including top and bottom halves, said top and bottom halves being secured about said article, said top and bottom halves cooperatively defining an envelope having a shape corresponding at least in part to said shape of said article, whereby said envelope retains said article stationary within said package, said package including a plurality of corners and a plurality of supports, said corners including at least one support disposed in each of said plurality of corners having a plurality of strengthening ridges extending parallel to one another in a stepped configuration, said plurality of supports extending vertically from said envelope and having a top surface and a bottom surface, said top surfaces forming a top common plane and said bottom surfaces forming a bottom common plane, said bottom common plane substantially parallel to said top common plane, said envelope and said article entirely recessed from said top common plane and said bottom common plane to define a crush zone surrounding said envelope and said article, each of said supports includes a first portion defined by said first half and a second portion defined by said second half, each of said first support portions of said first half being vertically aligned with a corresponding one of said second support portions of said second half, and a nesting protrusion on at least one of said top half and said bottom half, and the other of said top half and said bottom half includes a corresponding recess such that when two of said packages are stacked one atop the other said protrusion of one of said packages will nest within said recess of the other of said packages.

21. A packaged article comprising:

an article having a shape;

a package manufactured from an impact-modified plastic including first and second halves, said first and second halves being secured about said article, said first and second halves cooperatively defining an envelope having a shape corresponding at least in part to said shape of said article, whereby said envelope retains said article stationary within said package, said package including a plurality of supports extending outwardly from said envelope and having an outermost extent, said envelope and said article entirely recessed from said outermost extent of said plurality of supports to define a crush zone surrounding said envelope and said article said supports of said first half are vertically offset from said supports of said second half and being configured such that said supports of said first half are adapted to nest between said supports of said second half when two of said packages are stacked vertically one atop another to interlock said two stacked packages said plurality of supports includes a plurality of supports extending in a transverse direction and a plurality of supports extending in a longitudinal direction.

22. The combination of claim 11 wherein said plurality of fragility supports include a plurality of transverse supports on said top and bottom.

23. The combination of claim 22 wherein said plurality of fragility supports include a plurality of side supports on said top and said bottom.

24. The combination of claim 23 wherein said transverse supports include a plurality of outermost transverse supports, said side supports extend to and merge with said outermost transverse supports.

25. The combination of claim 24 comprising:

a plurality of corner supports on said top and said bottom; and a nesting protrusion one of said top and said bottom and the other of said top shell half and said bottom includes a corresponding recess such that when a pair of said packages are stacked one atop the other, the protrusion of one of said packages will nest within the recess of the other of said packages.

26. The combination of claim 25 comprising a plurality of center supports on said top and bottom, said center supports defining a center recess such that when a plurality of said packages are stocked one atop the other, the top packages may be offset from the bottom packages.

27. The combination of claim 25 wherein said nesting protrusions of the top packages interconnects with said center recesses on said top shell halves of the bottom packages.

* * * * *